US007688287B2

(12) United States Patent
Tokunaga et al.

(10) Patent No.: US 7,688,287 B2
(45) Date of Patent: Mar. 30, 2010

(54) PLASMA DISPLAY APPARATUS

(75) Inventors: Tsutomu Tokunaga, Yamanashi-ken (JP); Yoshichika Sato, Yamanashi-ken (JP); Nobuhiko Saegusa, Yamanashi-ken (JP)

(73) Assignee: Panasonic Corporation, Osaka (JP)

( * ) Notice: Subject to any disclaimer, the term of this patent is extended or adjusted under 35 U.S.C. 154(b) by 938 days.

(21) Appl. No.: 11/232,881

(22) Filed: Sep. 23, 2005

(65) Prior Publication Data

US 2006/0066519 A1 Mar. 30, 2006

(30) Foreign Application Priority Data

Sep. 24, 2004 (JP) ..... 2004-276976
Oct. 8, 2004 (JP) ..... 2004-296001

(51) Int. Cl.
*G09G 3/28* (2006.01)

(52) U.S. Cl. ..... 345/63; 345/60; 345/65

(58) Field of Classification Search ..... 345/55, 345/60–68, 204; 374/164; 250/338.1, 341; 315/169.1, 169.2, 169.3; 313/486, 581, 582, 313/583, 586, 584, 495, 496, 570, 576, 572; 117/88, 101, 103, 104, 994
See application file for complete search history.

(56) References Cited

U.S. PATENT DOCUMENTS 5,054,936 A * 10/1991 Fraden ..... 374/164
5,061,687 A * 10/1991 Takada et al. ..... 505/238
5,770,921 A * 6/1998 Aoki et al. ..... 313/581
5,993,543 A * 11/1999 Aoki et al. ..... 117/88
7,113,153 B2 * 9/2006 Kubota et al. ..... 345/60
2001/0050528 A1 * 12/2001 Sawada et al. ..... 313/486
2002/0158857 A1 * 10/2002 Iisaka ..... 345/204
2003/0001804 A1 * 1/2003 Naganuma ..... 345/63
2003/0011543 A1 * 1/2003 Hosoi et al. ..... 345/63
2003/0067269 A1 * 4/2003 Mitamura et al. ..... 313/586
2004/0075388 A1 * 4/2004 Miyashita et al. ..... 313/586
2004/0085021 A1 * 5/2004 Hibino et al. ..... 313/582
2004/0233133 A1 * 11/2004 Kong et al. ..... 345/60
2006/0290602 A1 12/2006 Ikeda et al.

FOREIGN PATENT DOCUMENTS

JP 09-006283 1/1997
JP 09-138668 5/1997
JP 2000103614 A * 4/2000

OTHER PUBLICATIONS

Grant et al., "Time resolved liminescence spectroscopy of alkaline earth oxides after pulsed electron beam irradiation. II. Spectra and thresholds of MgO", J. Chem. Phys. 90 (1989) 807.*
Caulfield et al., "A temperature effect in the luminescence emission from electron-irradiated MgO", J. Chem. Phys. 92 (1990) 6441.*
Kim et al. "Electron and photon emission accompanying the abrasion of MgO with diamond", Tribology Letters 1 (1995) 147-157.*

* cited by examiner

*Primary Examiner*—Amare Mengistu
*Assistant Examiner*—Dmitriy Bolotin
(74) *Attorney, Agent, or Firm*—Drinker Biddle & Reath LLP

(57) ABSTRACT

A plasma display apparatus includes a plasma display panel. Pulse voltage values and/or pulse widths of a variety of drive pulses that are applied to the plasma display panel are adjusted in accordance with the accumulated usage time of the plasma display panel.

22 Claims, 23 Drawing Sheets

PLASMA DISPLAY APPARATUS

BACKGROUND OF THE INVENTION

1. Field of the Invention

The present invention relates to a plasma display apparatus having a plasma display panel.

2. Description of the Related Art

Plasma display apparatuses having a plasma display panel (referred to as "PDP" hereinafter) are marketed as thin-type, large-screen display devices. In the PDP, discharge cells corresponding to pixels are arranged in a matrix shape. The PDP implements an image display by using the phenomenon of light emission in accordance with discharge that is induced in each of the discharge cells. Therefore, the discharge voltage of discharge cells decreases as a result of long-term usage and the PDP tends to produce erroneous discharge. To deal with this problem, some display apparatus control a discharge-sustaining voltage that is applied to the discharge cells in accordance with the PDP usage time. One of such apparatus is disclosed in Japanese Patent Application Kokai (Laid Open) No. 9-138668. In this display apparatus, by referencing information indicating the predicted transition of the discharge-sustaining voltage corresponding with the usage time (see FIG. 6 of Japanese Patent Application Kokai No. 9-138668), an output voltage of a power supply circuit is controlled such that the discharge-sustaining voltage has an appropriate value that reflects the apparatus usage time.

However, the output voltage control of such a power supply circuit cannot adequately suppress image quality degradation caused by long-term usage.

Further, there is another problem. When the temperature of the environment in which the plasma display apparatus is used drops, the discharge cells of the PDP discharge erroneously and the display quality drops. To cope with this problem, some plasma display apparatus heat the PDP when the temperature of the PDP is low. One of such apparatus is disclosed in Japanese Patent Application Kokai No. 9-6283.

However, with such a method, a heater for uniformly heating the whole of the PDP must be mounted and the structure of the display apparatus becomes complicated.

SUMMARY OF THE INVENTION

One object of the present invention is to provide a plasma display apparatus that can suppress image degradation caused by long-term usage.

Another object of the present invention is to provide a plasma display apparatus that can maintain favorable image quality even at low temperature, by suppressing erroneous discharge at low temperatures.

According to one aspect of the present invention, there is provided a plasma display apparatus having a plasma display panel. The plasma display panel has a plurality of row electrode pairs and a plurality of column electrodes. The row electrode pairs extend perpendicularly to the column electrodes. In the plasma display panel, a plurality of discharge cells are formed at intersections between the row electrode pairs and the column electrodes. The discharge cells serve as pixels. Each discharge cell has a discharge space. The plasma display apparatus includes a magnesium oxide layer which has magnesium oxide crystals that is formed on a predetermined face of each discharge cell in contact with the discharge space and performs cathode luminescence light emission with a peak in a 200 to 300 nm waveband as a result of being excited through electron beam irradiation. The plasma display apparatus also includes a drive unit that causes discharge in the discharge space by applying a drive pulse to each of the row electrode pairs and each of the column electrodes in accordance with a picture signal in each of a plurality of subfields. These subfields constitute a unit display period of the picture signal. The plasma display apparatus also includes a control unit that adjusts the pulse voltage value and/or pulse width of the drive pulse in accordance with the accumulated usage time of the plasma display panel.

According to another aspect of the present invention, there is provided a plasma display apparatus having a plasma display panel. The plasma display panel has a plurality of row electrode pairs and a plurality of column electrodes. The row electrode pairs extend perpendicularly to the column electrodes. A plurality of discharge cells are formed at intersections between the row electrode pairs and the column electrodes. Each discharge cell has a discharge space. The plasma display apparatus includes a magnesium oxide layer which has magnesium oxide crystals that is formed on a predetermined face of each discharge cell in contact with the discharge space and performs cathode luminescence light emission with a peak in a 200 to 300 nm waveband as a result of being excited through electron beam irradiation. The plasma display apparatus also includes a drive portion that causes discharge in the discharge space by applying a drive pulse to each of the row electrode pairs and each of the column electrodes in accordance with a picture signal in each of a plurality of subfields. These subfields constitute a unit display period of the picture signal. The plasma display apparatus also includes a panel temperature detector for detecting the temperature of the plasma display panel. The plasma display apparatus also includes a control portion that changes the pulse width of the drive pulse in accordance with the detected temperature of the plasma display panel.

DETAILED DESCRIPTION OF THE INVENTION

Embodiments of the present invention will be described in detail hereinbelow with reference to the drawings.

FIRST EMBODIMENT

Referring to FIG. 1 to FIG. 16, a plasma display apparatus 49 according to a first embodiment of the present invention will be described.

Figure 1:
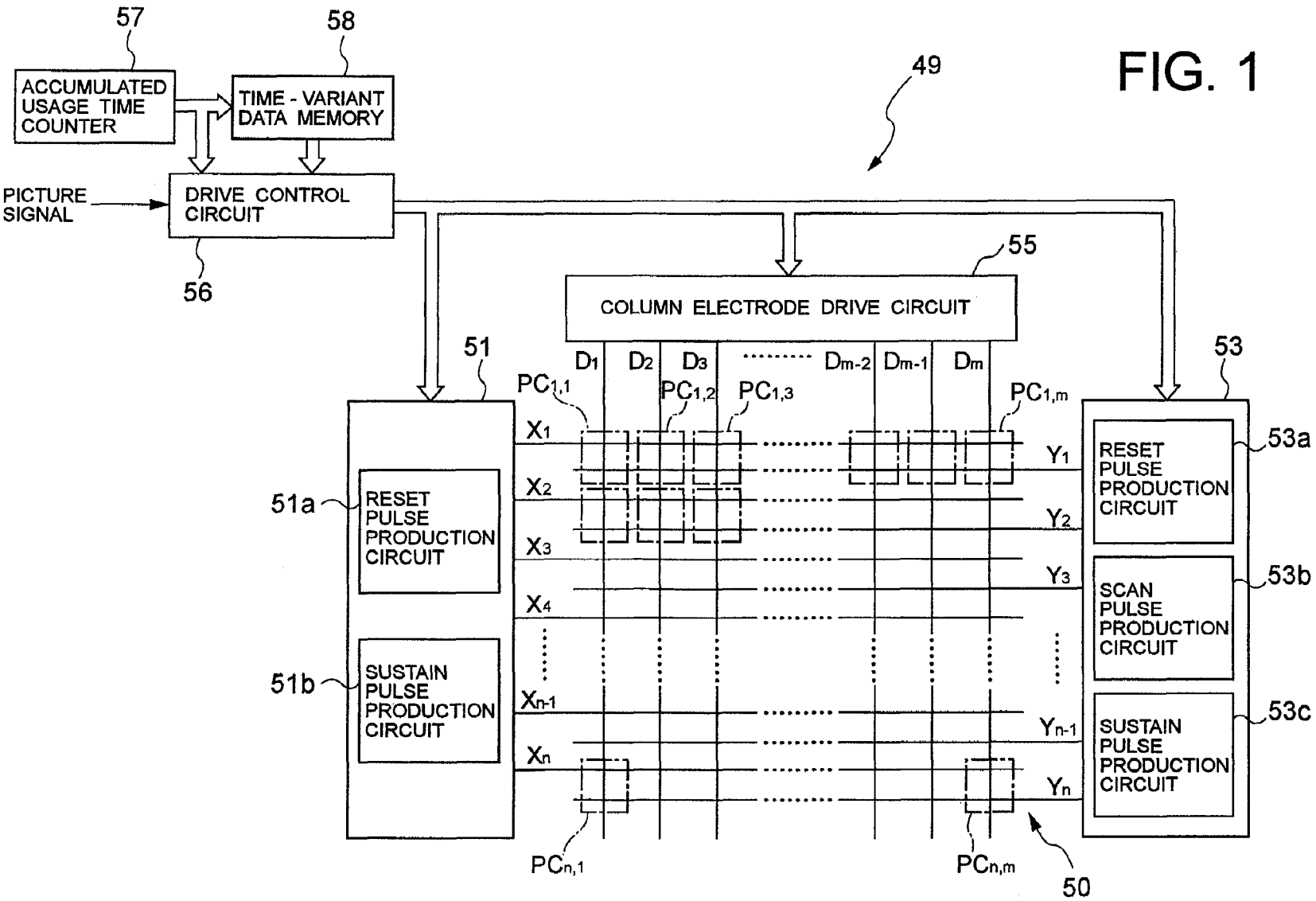
FIG. 1 shows a schematic constitution of the plasma display apparatus according to a first embodiment of the present invention.

As shown in FIG. 1, the plasma display apparatus 49 includes a PDP (plasma display panel) 50, a row electrode X drive circuit 51, a row electrode Y drive circuit 53, a column electrode drive circuit 55, a drive control circuit 56, a usage time counter (timer) 57 and a time-variant data memory 58.

The PDP 50 has column electrodes $D_1$ to $D_m$ and row electrodes $X_1$ to $X_n$ and $Y_1$ to $Y_n$. The column electrodes $D_1$ to $D_m$ extend in the height direction (vertical direction) of a two-dimensional display screen of the PDP 50. The row electrodes $X_1$ to $X_n$ and row electrodes $Y_1$ to $Y_m$ extend in the width direction (horizontal direction) of the display screen of the PDP 50. Each two adjacent row electrodes $X_i$ and $Y_i$ define one row electrode pair. These row electrode pairs $(X_1, Y_1)$, $(X_2, Y_2)$, $(X_3, Y_3)$, . . . , $(X_n, Y_n)$ define first to nth display lines in the PDP50. Discharge cells PC which serve as pixels are formed at the intersections (areas surrounded by single-dot chain lines in FIG. 1) between the display lines and column electrodes $D_1$ to $D_m$. Specifically, the discharge cells $PC_{1,1}$ to $PC_{1,m}$ belonging to the first display line, discharge cells $PC_{2,1}$ to $PC_{2,m}$ belonging to the second display line, . . . , and discharge cells $PC_{n,1}$ to $PC_{n,m}$ belonging to the nth display line are arranged in a matrix shape in the PDP50.

Figure 2:
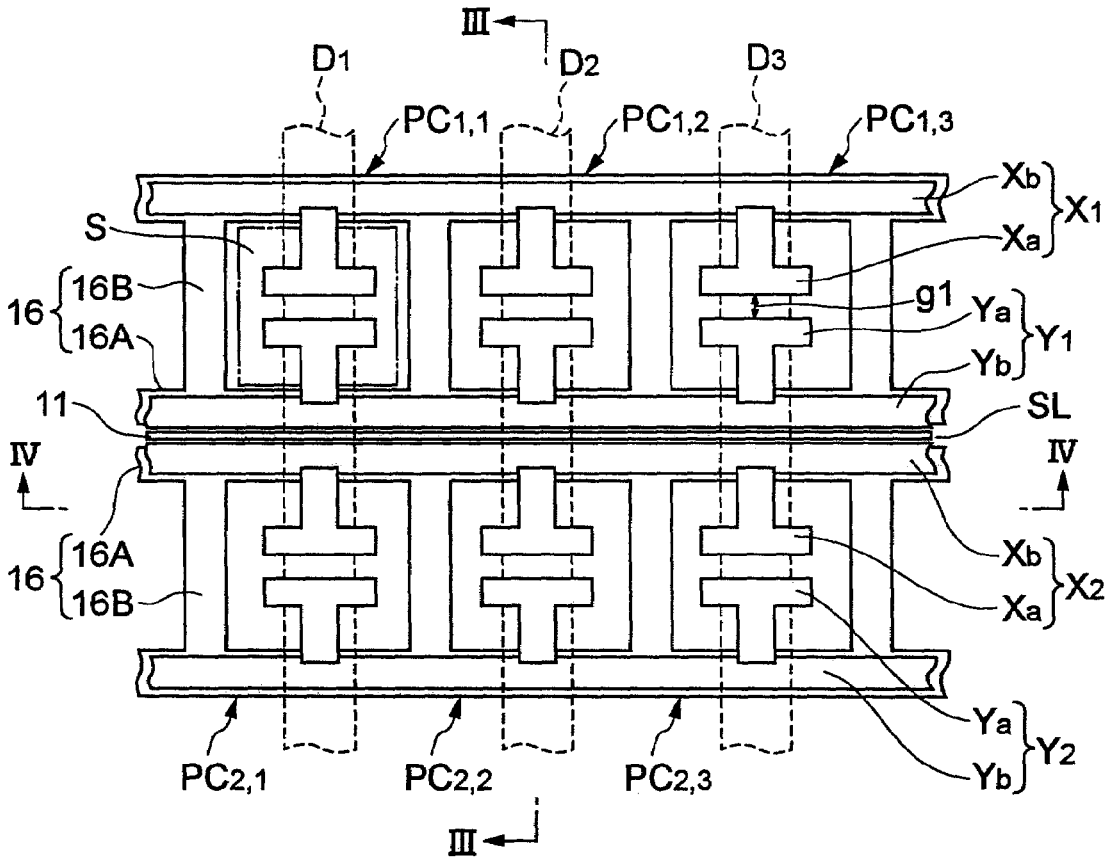
FIG. 2 is a front view that schematically shows the internal structure of a PDP mounted in the plasma display apparatus shown in FIG. 1 when viewed from the display screen side.

FIG. 2 is a view that schematically shows the internal structure of the PDP50 when viewed from the display screen side.

Figure 3:
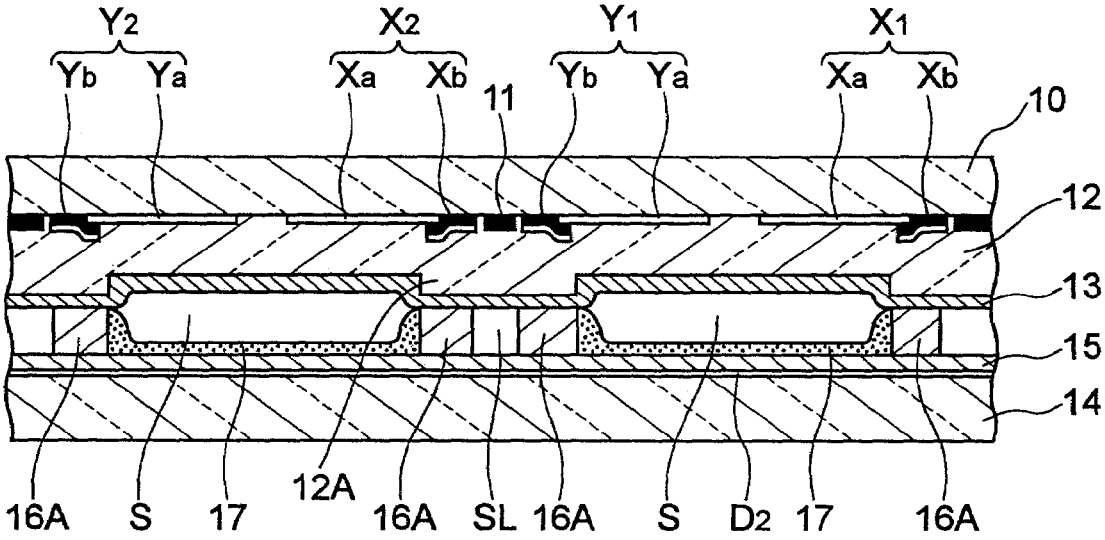
FIG. 3 shows a cross-sectional view taken along the line III-III in FIG. 2.
Figure 4:
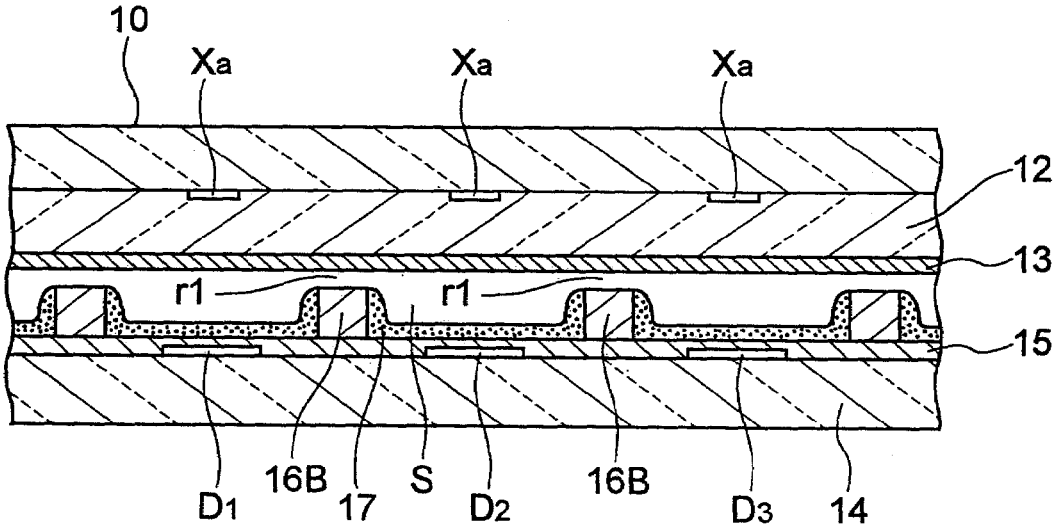
FIG. 4 shows a cross-sectional view taken along the line IV-IV in FIG. 2.

FIG. 2 shows only part of the PDP 50. Specifically, the intersections between the column electrodes $D_1$ to $D_3$ and the first display line $(Y_1, X_1)$ and the second display line $(Y_2, X_2)$ of the PDP50 are only shown. FIG. 3 is a cross-sectional view of the PDP50 along the line III-III in FIG. 2 and FIG. 4 is a cross-sectional view of the PDP50 along the line IV-IV in FIG. 2.

As shown in FIG. 2, each of the row electrodes X has a bus electrode Xb that extends in the horizontal direction of the display screen, and a plurality of T-shaped transparent electrodes Xa that extend perpendicularly from the bus electrode Xb. Each T-shaped transparent electrode Xa is provided for the corresponding discharge cell PC. Each of the row electrodes Y has a bus electrode Yb that extends in the horizontal direction of the display screen, and a plurality of T-shaped transparent electrodes Ya that extend perpendicularly from the bus electrode Yb. Each T-shaped transparent electrode Ya is provided for the corresponding discharge cell PC. The transparent electrodes Xa and Ya are made from a transparent electrically conductive film of ITO or the like, for example, and the bus electrodes Xb and Yb are made from a metal film, for example. As shown in FIG. 3, the row electrodes X and row electrodes Y are formed on the rear side of the transparent substrate 10. The substrate 10 is a front face (display screen) of the PDP50. In each row electrode pair (X, Y), the transparent electrode Xa extend towards the mating transparent electrode Ya, and the spacing between the two T-heads of these transparent electrodes Xa and Ya defines a discharge gap g1 of a predetermined value. A black or dark-colored light absorption layer (light-blocking layer) 11 that extends in the horizontal direction of the display screen is formed between two adjacent row electrode pairs ($X_1$, $Y_1$) and ($X_2$, $Y_2$) on the rear side of the substrate 10. A dielectric layer 12 is formed to cover the row electrode pairs (X, Y) on the rear side of the substrate 10. The dielectric layer 12 has raised (thicker) portions 12A. Each raised dielectric layer 12A is formed in a part corresponding with an area where a light absorption layer 11 and neighboring bus electrodes Xb and Yb are formed. A magnesium oxide layer 13 that includes magnesium oxide (MgO) crystals is formed on the surfaces of the dielectric layer 12 and raised portions 12A. The magnesium oxide layer 13 performs cathode luminescence light emission (hereinafter 'CL light emission') with a peak in the 200 to 300 nm waveband upon excitation when irradiated by an electron beam.

The column electrodes D extend in a direction orthogonal to the row electrode pairs (X, Y) on a rear substrate 14 of the PDP 50. The rear substrate 14 is parallel to the front substrate 10. Each column electrode D faces the corresponding transparent electrodes Xa and Ya of the row electrode pairs (X, Y). A column electrode protective layer 15 that covers the column electrodes D is also formed on the rear substrate 14. The column electrode protective layer 15 is white. Barrier walls 16 are formed on the column electrode protective layer 15. Each barrier wall 16 is formed in a ladder shape by two lateral walls 16A and a plurality of vertical walls 16B. The lateral walls 16A extend in the width (horizontal) direction of the display screen in positions corresponding with the bus electrodes Xb and Yb of the row electrode pair (X, Y). The vertical walls 16B extend in the height (vertical) direction of the display screen in middle positions between the respective adjacent column electrodes D. The ladder-shaped barrier wall 16 is formed for each of the display lines of the PDP50, and a gap SL exists between each adjacent barrier walls 16, as shown in FIG. 2. The barrier wall 16 defines a plurality of discharge cells PC. Each discharge cell PC has an independent discharge space S and transparent electrodes Xa and Ya. A discharge gas which contains xenon gas fills each discharge space S. As shown in FIG. 3, a fluorescent layer 17 is formed to completely cover the side face of the horizontal wall 16A, the side face of the vertical wall 16B, and the surface of the column electrode protective layer 15 in each discharge cell PC. The fluorescent layer 17 is one of three types of fluorescent material, which are a fluorescent material emitting red light, a fluorescent material emitting green light, and a fluorescent material emitting blue light. The discharge space S and gap SL in each discharge cell PC are closed off from one another because the magnesium oxide layer 13 abuts against the horizontal wall 16A as shown in FIG. 3. On the other hand, as shown in FIG. 4, because the vertical wall 16B does not abut against the magnesium oxide layer 13, a gap r1 exists between the vertical wall 16B and the magnesium oxide layer 13. That is, the discharge spaces S of the respective discharge cells PC arranged continuously in the width direction of the display screen communicate with one another via the gaps r1.

Figure 5A:
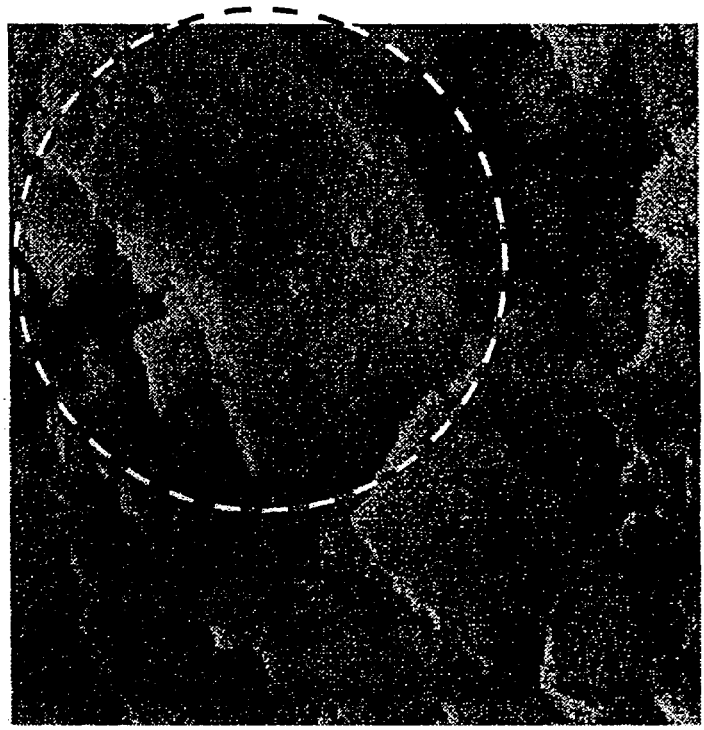
FIG. 5A shows an example of magnesium oxide single crystals.
Figure 5B:
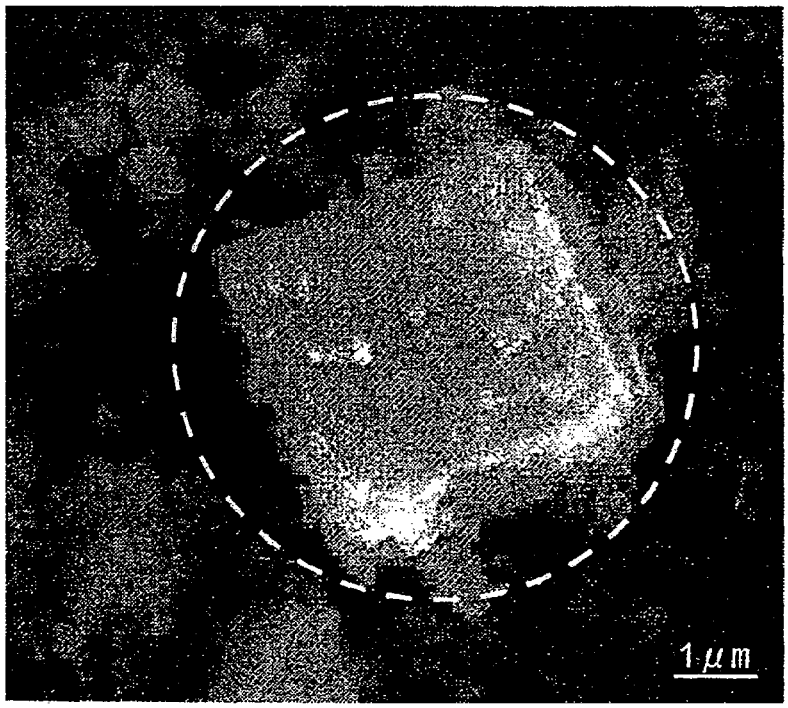
FIG. 5B shows another example of magnesium oxide single crystals.
Figure 6:
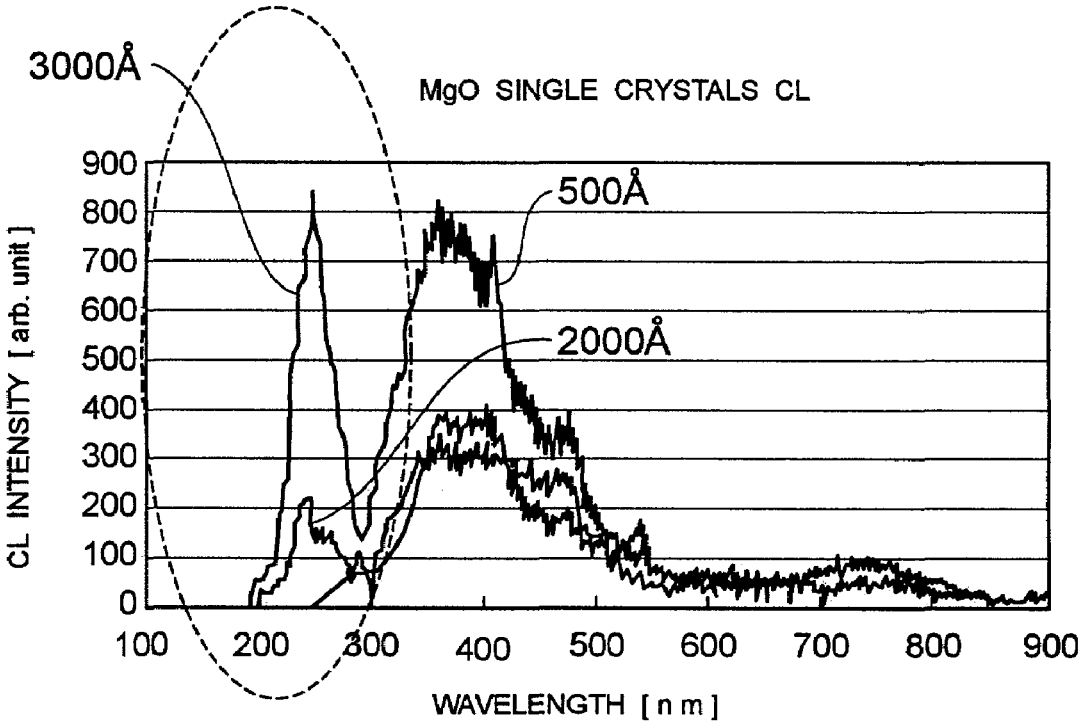
FIG. 6 is a graph showing the relationship between the grain diameter of the magnesium oxide single crystals and the wavelength of the CL light emission.
Figure 7:
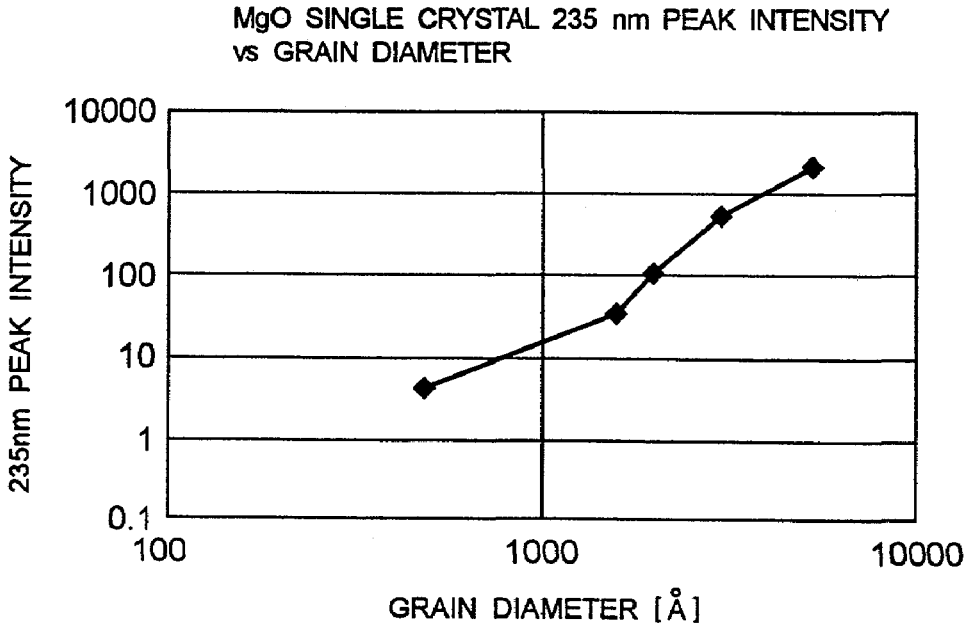
FIG. 7 is a graph showing the relationship between the grain diameter of the magnesium oxide single crystals and the intensity of 235 nm CL light emission.
Figure 8:
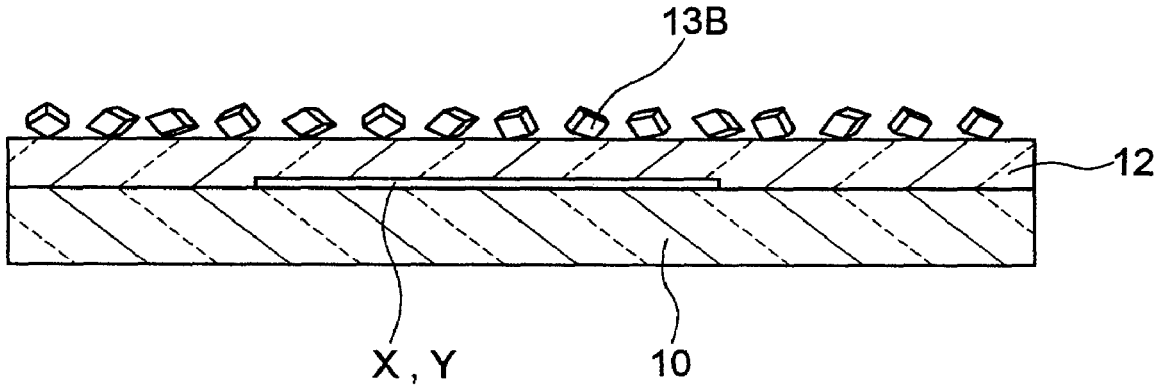
FIG. 8 shows a magnesium oxide layer which is formed by causing magnesium oxide single crystal fine powder to adhere to the surfaces of a dielectric layer including raised portions.

The magnesium oxide crystals of the magnesium oxide layer 13 contain vapor-phase magnesium oxide crystals that are obtained by subjecting magnesium vapor to vapor-phase oxidation. The magnesium vapor is produced by heating magnesium. The vapor-phase magnesium oxide crystals contain magnesium single crystals of a grain diameter of 2000 angstroms or more. The magnesium single crystals have a multilayer crystal structure in which cubic crystals are fitted together as shown in the SEM photo of FIG. 5A or a cubic single-crystal structure as shown in the SEM photo of FIG. 5B. The magnesium single crystals perform CL light emission with a peak in the 200 to 300 nm waveband (close to 235 nm within 230 to 250 nm in particular) as shown in FIG. 6 upon excitation by means of electron-beam irradiation. In this light emission, as shown in FIG. 7, the larger the grain diameter of the vapor-phase magnesium oxide crystals, the greater the peak intensity of the CL light emission. In other words, when the magnesium is heated at a higher temperature than normal during generation of vapor-phase magnesium oxide crystals, vapor-phase magnesium oxide single crystals with an average grain diameter of 500 angstroms and relatively large single crystals with a grain diameter of at least 2000 angstroms as shown in FIG. 5A or FIG. 5B are formed. Because the heating temperature of magnesium is higher than normal temperature, the length of the flames when magnesium reacts with oxygen becomes also longer. Therefore, the temperature difference between these flames and the surroundings is large and, as a result, it is inferred that the larger the grain diameter of the vapor-phase magnesium oxide single crystals, the more the single crystals with a high energy level corresponding with 200 to 300 nm (235 nm in particular) are contained. In comparison with magnesium oxide that is generated by other methods, the vapor phase magnesium oxide single crystals have characteristics such as highly pure, minute grains and small grain cohesion. In this embodiment, vapor phase magnesium oxide single crystals with an average grain diameter of 500 angstrom or more and preferably with an average grain diameter of 2000 angstrom or more are employed. The grain diameter is measured by means of BET. The magnesium oxide layer 13 is formed by causing such vapor phase magnesium oxide single crystals to adhere to the surface of the dielectric layer 12 as shown in FIG. 8 by means of spraying, electrostatic coating, or the like. Alternatively, the magnesium oxide layer 13 may be formed by forming a thin-film magnesium oxide layer by means of vapor deposition or sputtering on the surface of the dielectric layer 12 and raised portions 12A and then causing the vapor phase magnesium oxide single crystals to adhere to the thin-film magnesium oxide layer.

The row electrode X drive circuit 51 includes a reset pulse production circuit 51*a* and a sustain pulse production circuit 51*b*. The reset pulse production circuit 51*a* of the row electrode X drive circuit 51 produces a reset pulse having a pulse voltage that is indicated by a reset pulse generation signal supplied by the drive control circuit 56, and applies the reset pulse to the row electrodes X of the PDP50. The sustain pulse production circuit 51*b* of the row electrode X drive circuit 51 produces a sustain pulse having a pulse voltage that is indicated by a sustain pulse generation signal supplied by the drive control circuit 56 and applies the sustain pulse to the row electrodes X of the PDP50. The row electrode Y drive circuit 53 includes a reset pulse production circuit 53*a*, a scan pulse production circuit 53*b* and a sustain pulse production circuit 53*c*. The reset pulse production circuit 53*a* of the row electrode Y drive circuit 53 produces a reset pulse having a pulse voltage that is indicated by a reset pulse generation signal supplied by the drive control circuit 56 and applies the reset pulse to the row electrodes Y of the PDP50. The scan pulse production circuit 53*b* of the row electrode Y drive circuit 53 produces a scan pulse having a pulse voltage that is indicated by a scan pulse generation signal supplied by the drive control circuit 56 and sequentially applies the scan pulse to the row electrodes $Y_1$ to $Y_n$ of the PDP50. The sustain pulse production circuit 53*c* of the row electrode Y drive circuit 53 produces a sustain pulse having a pulse voltage that is indicated by a sustain pulse generation signal supplied by the drive control circuit 56 and applies the sustain pulse to the row electrodes Y of the PDP50. The column electrode drive circuit 55 produces a pixel data pulse that is applied to the column electrodes D of the PDP50 in accordance with a pixel data pulse generation signal supplied by the drive control circuit 56.

The accumulated usage time counter 57 measures the accumulated time when the plasma display apparatus 49 is in a turned-on state and supplies accumulated usage time information indicating the accumulated time to the drive control circuit 56 and time-variant data memory 58.

Figure 9A:
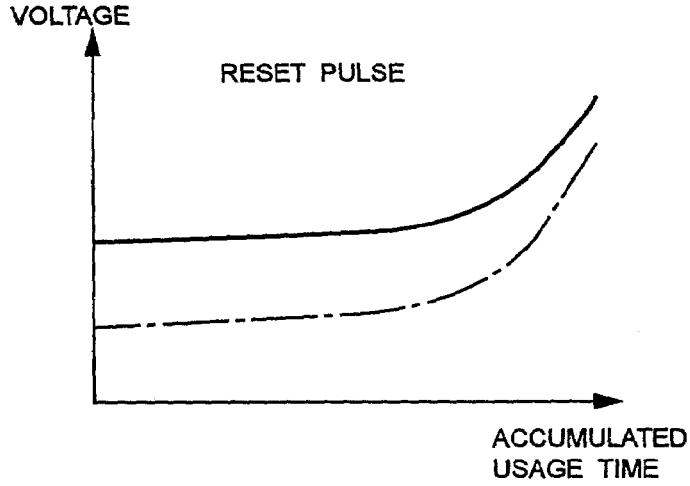
FIG. 9A shows prediction information for the optimum pulse voltage value of a reset pulse with respect to the accumulated usage time of the PDP.
Figure 9B:
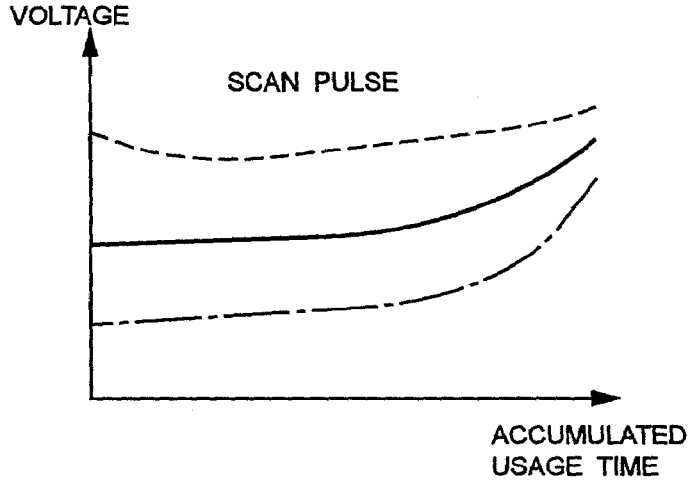
FIG. 9B shows prediction information for the optimum pulse voltage value of a scanning pulse with respect to the accumulated usage time of the PDP.
Figure 9C:
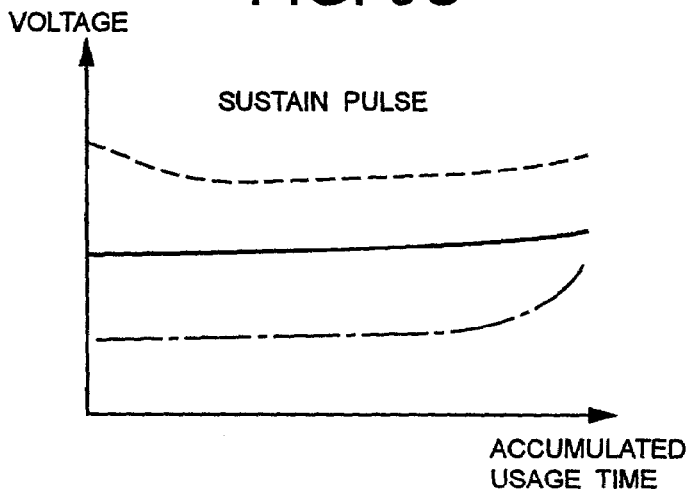
FIG. 9C shows prediction information for the optimum pulse voltage value of a sustain pulse with respect to the accumulated usage time of the PDP.

The time-variant data memory 58 pre-stores information indicating the optimum pulse voltage of the reset pulse to the accumulated usage time as indicated by the solid line in FIG. 9A, information indicating the optimum pulse voltage of the scan pulse to the accumulated usage time as indicated by the solid line in FIG. 9B, and information indicating the optimum pulse voltage of the sustain pulse to the accumulated usage time as indicated by the solid line in FIG. 9C, for example. The time-variant data memory 58 receives the accumulated usage time information, reads information indicating the optimum pulse voltage values for the reset pulse, scan pulse, and sustain pulse based on the accumulated usage time information, and supplies the voltage value information to the drive control circuit 56. The dashed lines in FIGS. 9B and 9C indicate the transition of the maximum voltage value that can be taken for the pulse voltage of the sustain pulse and scan pulse and the dot-chain lines in FIGS. 9A to 9C indicate the transition of the minimum voltage value that can be taken for the pulse voltage of the reset pulse, sustain pulse and scan pulse. It is understood from FIGS. 9A to 9C that as the accumulated usage time increases, the optimum pulse voltage value of the scan pulse is greater than the optimum pulse voltage value of the sustain pulse and the optimum pulse voltage value of the reset pulse is greater than the optimum pulse voltage of the scan pulse.

Figure 10:
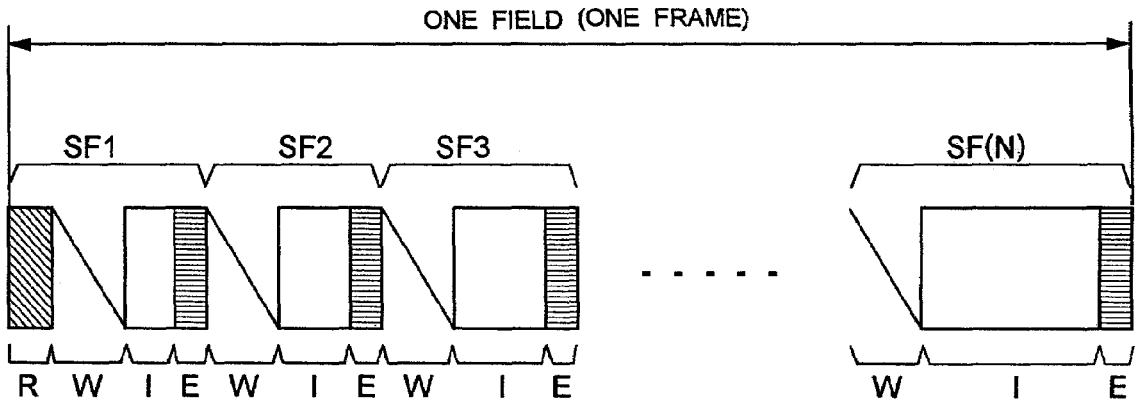
FIG. 10 shows an example of a light emission drive sequence that is adopted for the plasma display apparatus shown in FIG. 1.

The drive control circuit 56 supplies a variety of control signals for driving the PDP50 in accordance with the light emission drive sequence shown in FIG. 10, to the row electrode X drive circuit 51, row electrode Y drive circuit 53 and column electrode drive circuit 55 respectively. The light emission drive sequence of FIG. 10 is based on the subfield method (subframe method). A display period for one field (one frame) is divided into N subfields in the subfield method. Each subfield has its own weighting. In this light emission drive sequence, an address process W, sustain process I, and erasure process E are sequentially executed in each of the N subfields SF1 to SF(N). A reset process R is executed before the address process W only in the leading subfield SF1.

Figure 11:
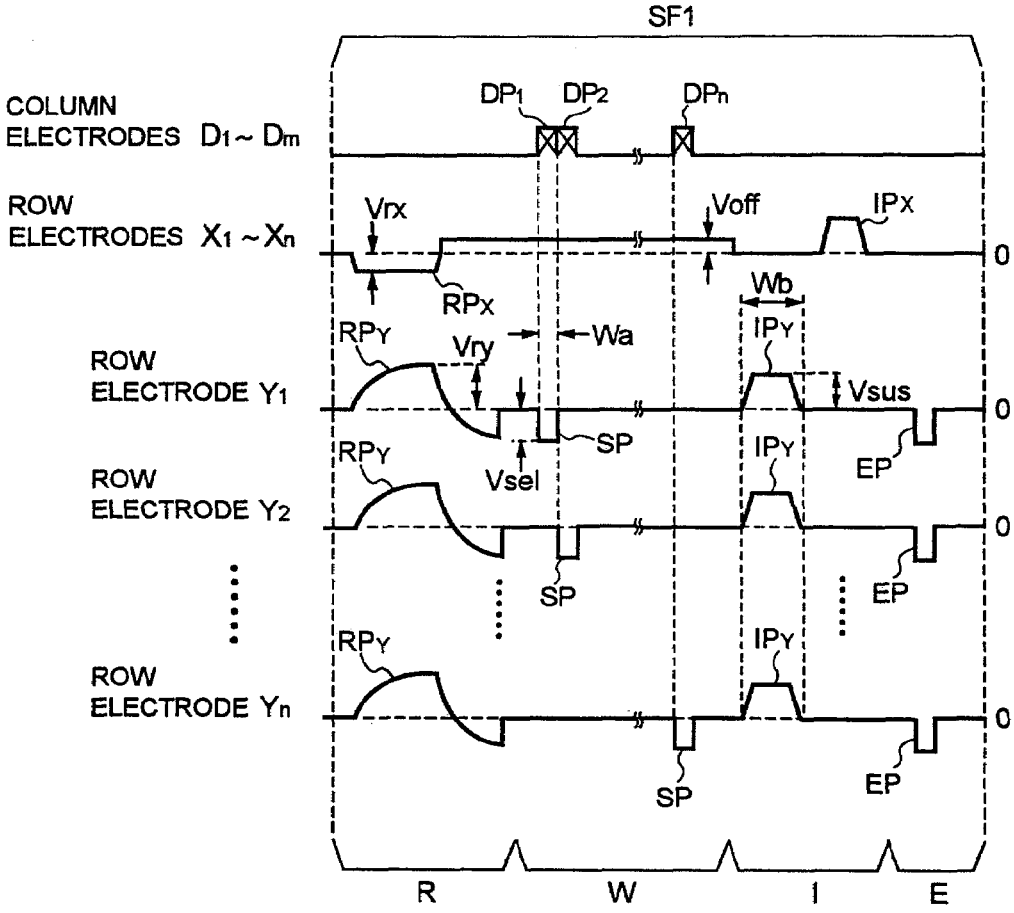
FIG. 11 shows a variety of drive pulses that are applied to the PDP in accordance with the light emission drive sequence shown in FIG. 10, and the application timing of the drive pulses.

FIG. 11 shows the application timing of a variety of drive pulses that are applied to column electrodes D and row electrodes X and Y of the PDP50 in the subfield SF1.

First, in the reset process R, the drive control circuit 56 supplies a reset pulse generation signal indicating the optimum pulse voltage value (indicated by a solid line in FIG. 9A) for the reset pulse that is read from the time-variant data memory 58, to the row electrode Y drive circuit 53 and row electrode X drive circuit 51 respectively. As a result, as shown in FIG. 11, the row electrode Y drive circuit 53 produces a reset pulse $RP_Y$ with a leading portion in which the voltage across the row electrodes Y rises slowly as time elapses and reaches a peak voltage Vry of a positive polarity and a trailing portion in which the voltage value drops slowly to reach a voltage of a negative polarity, and simultaneously applies the reset pulse $RP_Y$ to the row electrodes $Y_1$ to $Y_n$. The row electrode X drive circuit 51 produces a reset pulse $RP_X$ having a voltage Vrx of a negative polarity as shown in FIG. 11 that spans the rising segment of the voltage value of the reset pulse $RP_Y$ and applies the reset pulse $RP_X$ to the row electrodes $X_1$ to $X_n$ respectively. The row electrode Y drive circuit 53 and row electrode X drive circuit 51 generate reset pulses $RP_Y$ and $RP_X$ respectively so that the sum of the absolute value of the voltage Vry and the absolute value of the voltage Vrx equals the optimum pulse voltage value indicated by the reset pulse generation signal. That is, the pulse voltage Vry of the reset pulse $RP_Y$ and the pulse voltage Vrx of the reset pulse $RP_X$ are adjusted so that the sum of the absolute value of the pulse voltage Vry of the reset pulse $RP_Y$ and the absolute value of the pulse voltage Vrx of the reset pulse $RP_X$ becomes equal to the optimum pulse voltage value (indicated by the solid line in FIG. 9A) determined by the accumulated usage time at that point in time.

A weak write reset discharge is induced across the row electrodes X and Y in each of all the discharge cells $PC_{1,1}$ to $PC_{n,m}$ while the reset pulses $RP_Y$ and $RP_X$ are applied. After the write reset discharge ends, a wall charge of a predetermined amount is formed at the surface of the magnesium oxide layer 13 in the discharge space S of each discharge cell PC. Specifically, charge of a positive polarity is formed in the vicinity of the row electrodes X on the surface of the magnesium oxide layer 13 and charge of a negative polarity is formed in the vicinity of the row electrodes Y. Thereafter, when the voltage of the reset pulse $RP_Y$ drops slowly from Vry, a weak erasure reset discharge is induced over this interval across the row electrodes X and Y in all of the discharge cells $PC_{1,1}$ to $PC_{n,m}$. The wall charges formed in all of the discharge cells $PC_{1,1}$ to $PC_{n,m}$ are cancelled as a result of the erasure reset discharge. That is, as a result of the reset process R, all of the discharge cells $PC_{1,1}$ to $PC_{n,m}$ are initialized in a unlit state in which the amount of wall charge is less than a predetermined value.

Thereafter, in the address process W, the drive control circuit 56 supplies a pixel data pulse generation signal to the column electrode drive circuit 55 and supplies a scan pulse generation signal indicating the optimum pulse voltage value (indicated by the solid line in FIG. 9B) of the scan pulse read from the time-variant data memory 58 to the row electrode Y drive circuit 53. As a result, the column electrode drive circuit 55 first generates a pixel data pulse to decide whether to cause each of the discharge cells PC to emit light in the subfield concerned, based on the input picture signal. For example, the column electrode drive circuit 55 generates a high voltage pixel data pulse for each discharge cell PC when causing the discharge cell PC to emit light and a low voltage pixel data pulse when not causing the discharge cell PC to emit light. The column electrode drive circuit 55 sequentially applies this pixel data pulse for one display line's worth of discharge cells (m discharge cells) at a time as pixel data pulse groups $DP_1, DP_2, \ldots, DP_n$ to column electrodes $D_1$ to $D_m$. The row electrode Y drive circuit 53 sequentially applies a scan pulse SP with a voltage Vsel of a negative polarity to the row electrodes $Y_1$ to $Y_n$ in sync with the timing of each of the pixel data pulse groups $DP_1$ to $DP_n$. The row electrode Y drive circuit 53 produces the scan pulse SP so that the voltage Vsel is equal to the optimum pulse voltage value indicated by the scan pulse generation signal. That is, the pulse voltage Vsel of the scan pulse SP is adjusted to equal the optimum pulse voltage value (indicated by the solid line in FIG. 9B) decided by the accumulated usage time at that point in time. Address discharge is induced in only those discharge cells PC to which the scan pulse SP is applied and a high voltage pixel data pulse is applied, and a wall charge of a predetermined amount is formed at the surfaces of the magnesium oxide layer 13 and the fluorescent layer 17 respectively in the discharge space S of the discharge cell PC. On the other hand, address discharge is not induced in those discharge cells PC to which the scan pulse SP is applied but to which a low-voltage pixel data pulse is applied, so that the wall-charge formation state up until just before this point is maintained. That is, as a result of execution of the address process W, each of the discharge cells PC is brought into either a lit state where wall charge of a predetermined amount exists or an unlit state in which wall charge of a predetermined amount does not exist on the basis of the input picture signal.

In the sustain process I, the drive control circuit 56 supplies a sustain pulse generation signal indicating the optimum pulse voltage value (indicated by a solid line in FIG. 9C) of the sustain pulse that has been read from the time-variant data memory 58 to each of the row electrode X drive circuit 51 and row electrode Y drive circuit 53. As a result, the row electrode X drive circuit 51 and row electrode Y drive circuit 53 alternately produces sustain pulses $IP_X$ and $IP_Y$ repetitively with a voltage Vsus of a positive polarity and applies the sustain pulses $IP_X$ and $IP_Y$ to the row electrodes $X_1$ to $X_n$ and $Y_1$ to $Y_n$. The row electrode Y drive circuit 53 and row electrode X drive circuit 51 produce the sustain pulses $IP_Y$ and $IP_X$ respectively such that the voltage Vsus becomes equal to the optimum pulse voltage value indicated by the sustain pulse generation signal. That is, the pulse voltage Vsus of the sustain pulses $IP_X$ and $IP_Y$ is regulated to be equal to the optimum pulse voltage value (indicated by the solid line in FIG. 9C) determined by the accumulated usage time at that point in time. The number of times the sustain pulses $IP_X$ and $IP_Y$ are applied depends on the weighting of the luminance of each subfield. Each time the sustain pulses $IP_X$ and $IP_Y$ are applied, only the discharge cells PC that have been set in the lit mode state in which a wall charge of a predetermined amount is formed produce a sustain discharge, whereby the fluorescent layer 17 emits light in accordance with the discharge and an image is formed on the display screen of the panel.

In the erasure process E, the row electrode Y drive circuit 53 applies an erasure pulse EP of a positive polarity simultaneously to all the row electrodes $Y_1$ to $Y_n$. An erasure discharge is induced in all the discharge cells PC as a result of this application of the erasure pulse EP, and the wall charges remaining in the discharge cells PC are all cancelled (erased).

As mentioned earlier, the magnesium oxide layer 13 formed in each of the discharge cells PC contains comparatively large (at least 2000 angstroms) vapor-phase magnesium oxide single crystals of the shapes as shown in FIGS. 5A and 5B. As shown in FIG. 6, when these single crystals are irradiated with an electron beam, CL light emission with a peak in the bandwidth 300 to 400 nm and CL light emission with a peak in the bandwidth 200 to 300 nm (particularly in the 230 to 250 nm bandwidth, and more particularly around 235 nm) are induced, so that the vapor-phase magnesium oxide single crystals are considered to have an energy level that corresponds to 235 nm. As a result of having an energy level that corresponds to 235 nm, the vapor-phase magnesium oxide single crystals capture electrons for a long time (several msec). By causing the electrons to be discharged through the application of an electric field during selective discharge, it is inferred that the initial electrons required for discharge are obtained rapidly. Therefore, if vapor-phase magnesium oxide single crystals for CL light emission with a peak from 200 to 300 nm are contained in the magnesium oxide layer 13 as shown in FIG. 3, electrons in an adequate amount that is required to induce discharge in the discharge space S always exist. Accordingly, the discharge probability in the discharge space S is considerably high.

Figure 12:
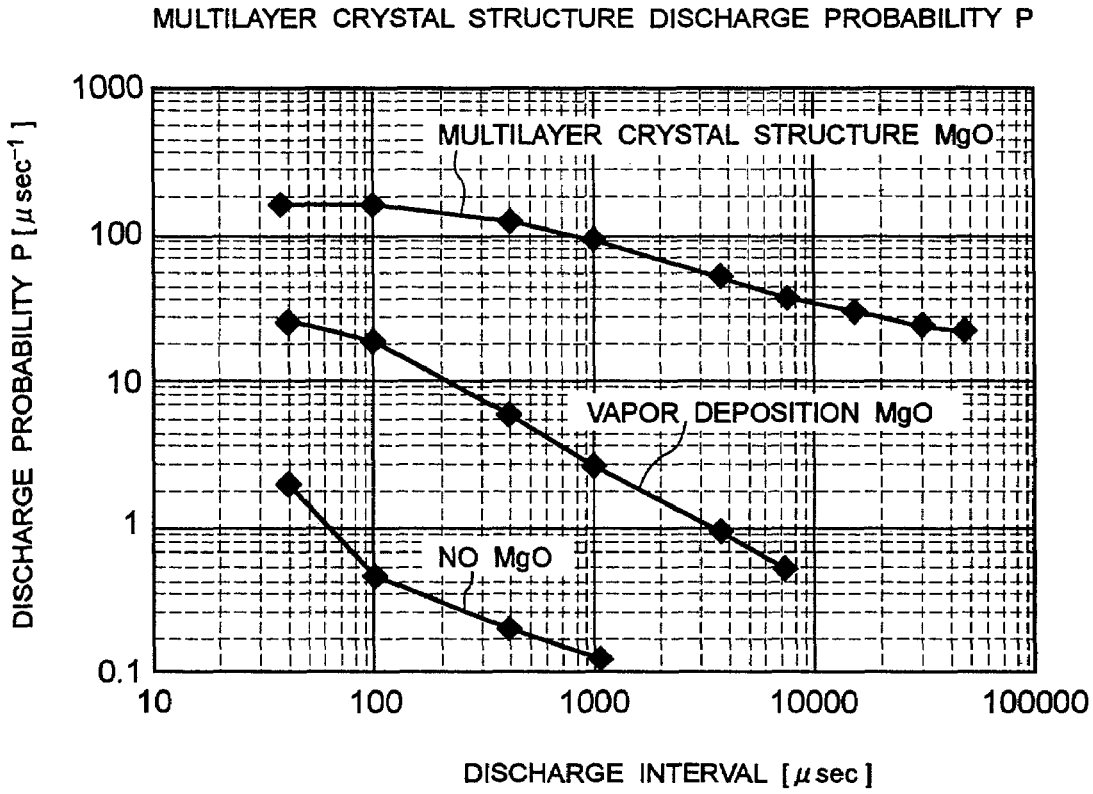
FIG. 12 shows the discharge probabilities in cases where a magnesium oxide layer is not provided in the discharge cells, where a magnesium oxide layer is formed by means of conventional vapor deposition, and where a magnesium oxide layer having vapor-phase magnesium oxide single crystals that produce CL light emission with a peak of 200 to 300 nm upon electron beam irradiation is provided.
Figure 13:
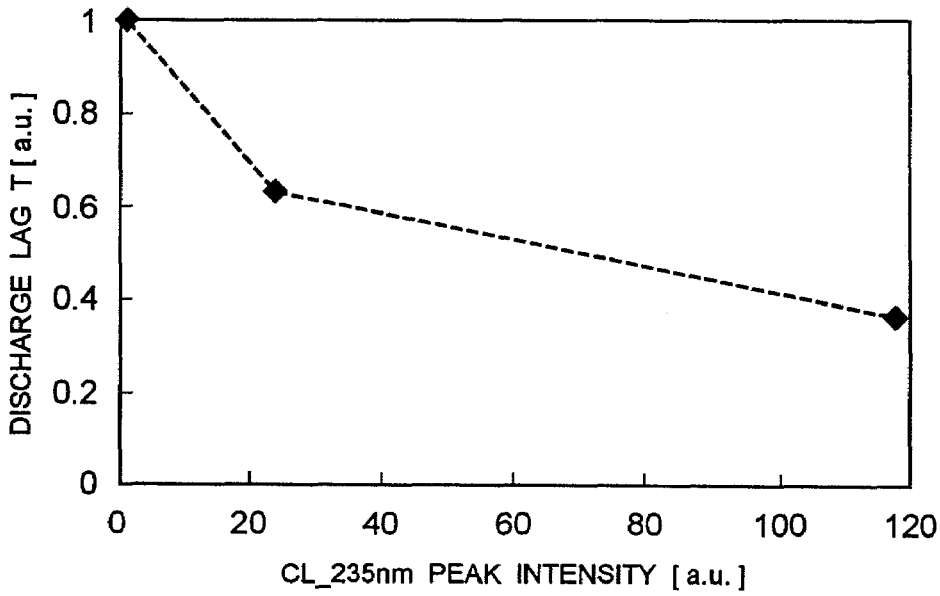
FIG. 13 shows the relationship between the 235 nm peak CL light emission intensity and the discharge lag time.

FIG. 12 shows the discharge probabilities in cases where a magnesium oxide layer is not provided in the discharge cells PC, where a magnesium oxide layer is formed by means of conventional vapor deposition, and where a magnesium oxide layer made from vapor-phase magnesium oxide single crystals of a multilayer single-crystal structure that produce CL light emission with a peak of 200 to 300 nm upon electron beam irradiation is provided. The horizontal axis in FIG. 12 represents the no discharge time or discharge interval, i.e., from when discharge is induced until next discharge is induced. Thus, when the magnesium oxide layer 13 made from the vapor-phase magnesium oxide single crystals that effect CL light emission with a peak from 200 to 300 nm as a result of electron beam irradiation is formed in the discharge space S of each discharge cell PC, the discharge probability increases in comparison with a case where a magnesium oxide layer is formed by means of conventional vapor deposition. As shown in FIG. 13, the larger the intensity of CL light emission when the vapor-phase magnesium oxide single crystals are irradiated with an electron beam, particularly of CL light emission with a peak of 235 nm, the more the discharge lag induced in the discharge space S can be reduced.

Therefore, even when the reset discharge is made weak by slowly producing a voltage transition of the reset pulse $RP_Y$ applied to the row electrodes Y as shown in FIG. 11 in order to increase contrast by suppressing the light emission in accordance with the reset discharge that does not play a part in the display image, a weak reset discharge can be induced stably for a short time. In particular, each of the discharge cells PC adopts a structure for inducing localized discharge in the vicinity of the discharge gap between the T-shaped transparent electrodes Xa and Ya. Therefore, a sudden strong reset discharge which would cause discharge of the whole of the row electrodes is suppressed and strong erroneous discharge between the column electrodes and row electrodes is also prevented. Because the discharge probability is high (the discharge lag is small), the priming effect resulting from the write reset discharge and erasure reset discharge in the reset process R continues for a long time. Hence, the address discharge induced in the address process W and the sustain discharge induced in the sustain process I are accelerated. As a result, the pulse width Wa of the pixel data pulse DP and scan pulse SP as shown in FIG. 11 that are applied to the column electrodes D and row electrodes Y to induce address discharge can be shortened and the processing time that is devoted to the address process W can be shortened to the same extent. Also, the pulse width Wb of the sustain pulse $IP_Y$ as shown in FIG. 11 that is applied to the row electrodes Y in order to induce sustain discharge can be shortened and the processing time that is devoted to the sustain process I can be shortened to the same extent. Therefore, the number of subfields that are to be provided in the display period of one field (or one frame) can be increased to the extent that the processing time that is devoted to the address process W and sustain process I respectively is shortened. Consequently, the number of grayscales can be increased.

As described above, the discharge probability in the respective discharge cells can be increased by providing the magnesium oxide layer 13 made from vapor-phase magnesium oxide single crystals which effects CL light emission with a peak of 200 to 300 nm upon electron beam irradiation. However, the voltage at the start of discharge in each discharge cell increases, and erroneous discharge is readily produced as a result of secular variation.

To prevent it, in the plasma display apparatus shown in FIG. 1, prediction information on the optimum pulse voltage values that make it possible to accurately induce the reset discharge, address discharge and sustain discharge are prestored as shown in FIGS. 9A to 9C in correspondence with the transition of the discharge start voltage that accompanies secular variation. The optimum pulse voltage values of the reset pulse, scan pulse, and sustain pulse respectively corresponding with the accumulated usage time of the PDP50 at the present time are extracted from the prediction information, and the pulse voltage values of the reset pulse, scan pulse, and sustain pulse are individually adjusted to equal the respective optimum pulse voltage values.

Accordingly, even when the discharge start voltage rises over time, a favorable display quality with less or no erroneous discharge can be maintained for a long time.

Figure 14A:
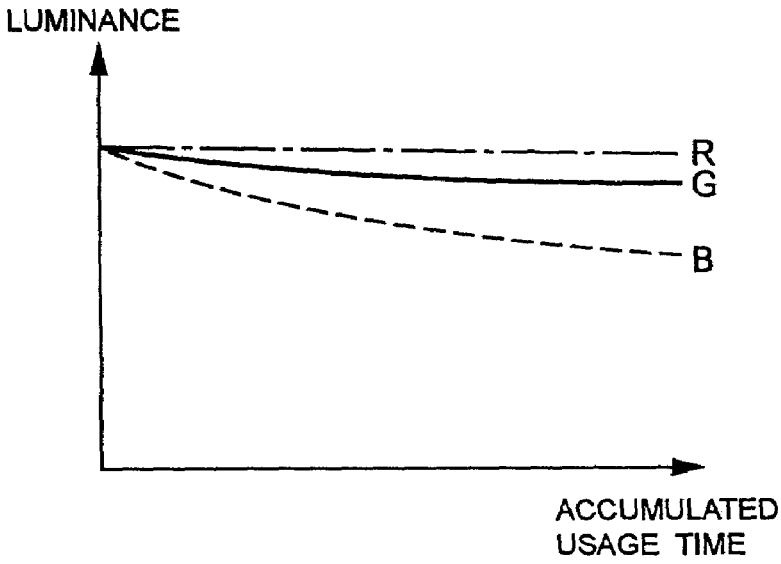
FIG. 14A shows the transition of the luminance drop of each color over the accumulated usage time of the PDP.

When the accumulated usage time of the PDP50 reaches a long time, an increase in the discharge start voltage occurs and a reduction in luminance that accompanies degradation of the fluorescent layer 17 occurs. As shown in FIG. 14A, the luminance reduction (indicated by the solid line) with respect to the accumulated usage time of the discharge cells PC with fluorescence that effects green light emission being employed as the fluorescent layer 17 is large in comparison with the luminance reduction (indicated by the dot-chain line) of discharge cells PC for which fluorescence that effects red light emission is employed. The luminance reduction (indicated by a dashed line) with respect to the accumulated usage time of the discharge cells PC for which fluorescence that effects blue light emission is employed is large in comparison with the luminance reduction (indicated by the dot chain line) of the discharge cells PC for which fluorescence that effects green light emission is employed. Therefore, a variation in the luminance level of the discharge cells PC effecting red light emission, the discharge cells PC effecting green light emission, and the discharge cells PC effecting blue light emission arises in accordance with secular variation. This produces the problem that the white balance shifts from the appropriate value.

Figure 14B:
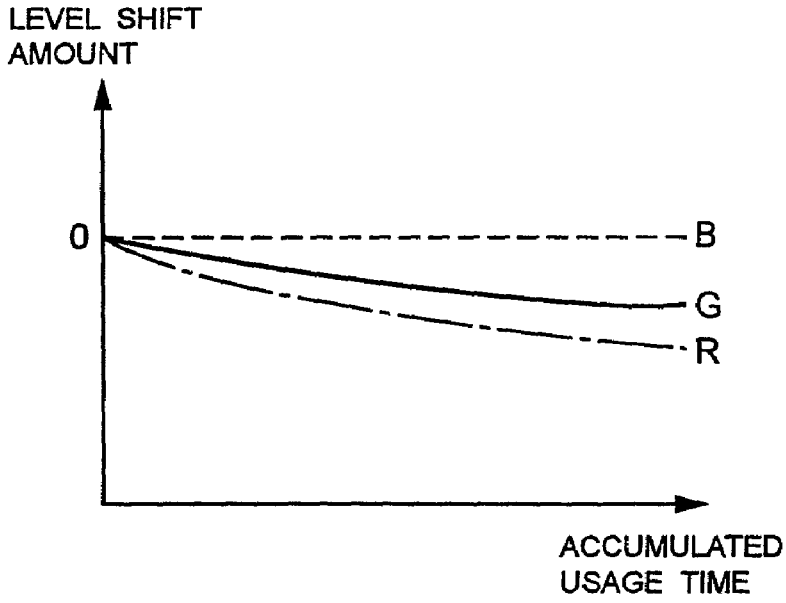
FIG. 14B shows the transition of the level shift of a picture signal for each color over the accumulated usage time of the PDP.

In order to correct this shift in the white balance, information indicating the level shift amount of each of the colors (R,G,B) corresponding with the accumulated usage time shown in FIG. 14B is stored in the time-variant data memory 58 together with information as shown in FIGS. 9A to 9C. The time-variant data memory 58 reads information indicating the level shift amount (indicated by a dashed line) for a blue signal component as shown in FIG. 14B that corresponds with the accumulated usage time of the PDP50 at the present time, the level shift amount (indicated by a solid line) for a green signal component, and the level shift amount (indicated by a dot-chain line) for a red signal component, and supplies this information to the drive control circuit 56. The drive control circuit 56 individually adjusts the levels of the red signal component, green signal component, and blue signal component respectively in the input picture signal by means of the level shift amounts of each color thus read from the time-variant data memory 58. As shown in FIG. 14B, the longer the accumulated usage time of the PDP50, the more the level reduction amount (indicated by the dot-chain line) for the red signal component is greater than the level reduction amount for the green signal component (indicated by the solid line). The level reduction amount for the green signal component becomes larger than the level reduction amount (indicated by the dashed line) for the blue signal component.

Accordingly, even when there is inconsistency in the luminance levels of the discharge cells PC effecting red light emission, the discharge cells PC effecting green light emission, and the discharge cells PC effecting blue light emission as a result of secular variation, level adjustment for each color at the input picture signal stage is made, and this level adjustment makes it possible to maintain an appropriate white balance that offsets the luminance level inconsistencies over long periods.

Figure 15:
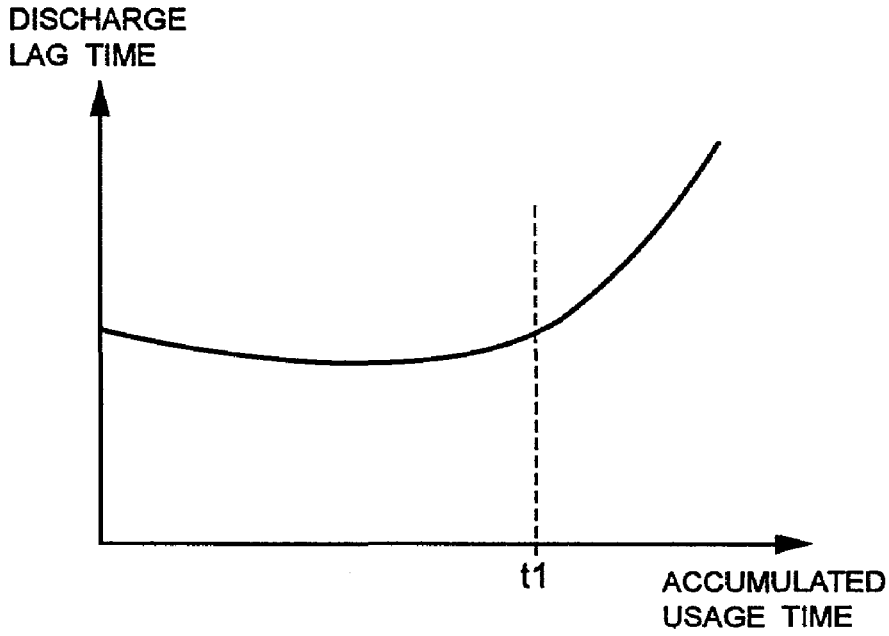
FIG. 15 shows the transition of the discharge lag time of the address discharge over the accumulated usage time of the PDP.

As shown in FIG. 15, when the accumulated usage time of the PDP50 increases and a predetermined time t1 has elapsed, a discharge lag starts to arise in the address discharge that is induced across the row electrodes Y and column electrodes D.

Figures 16A, 16B:
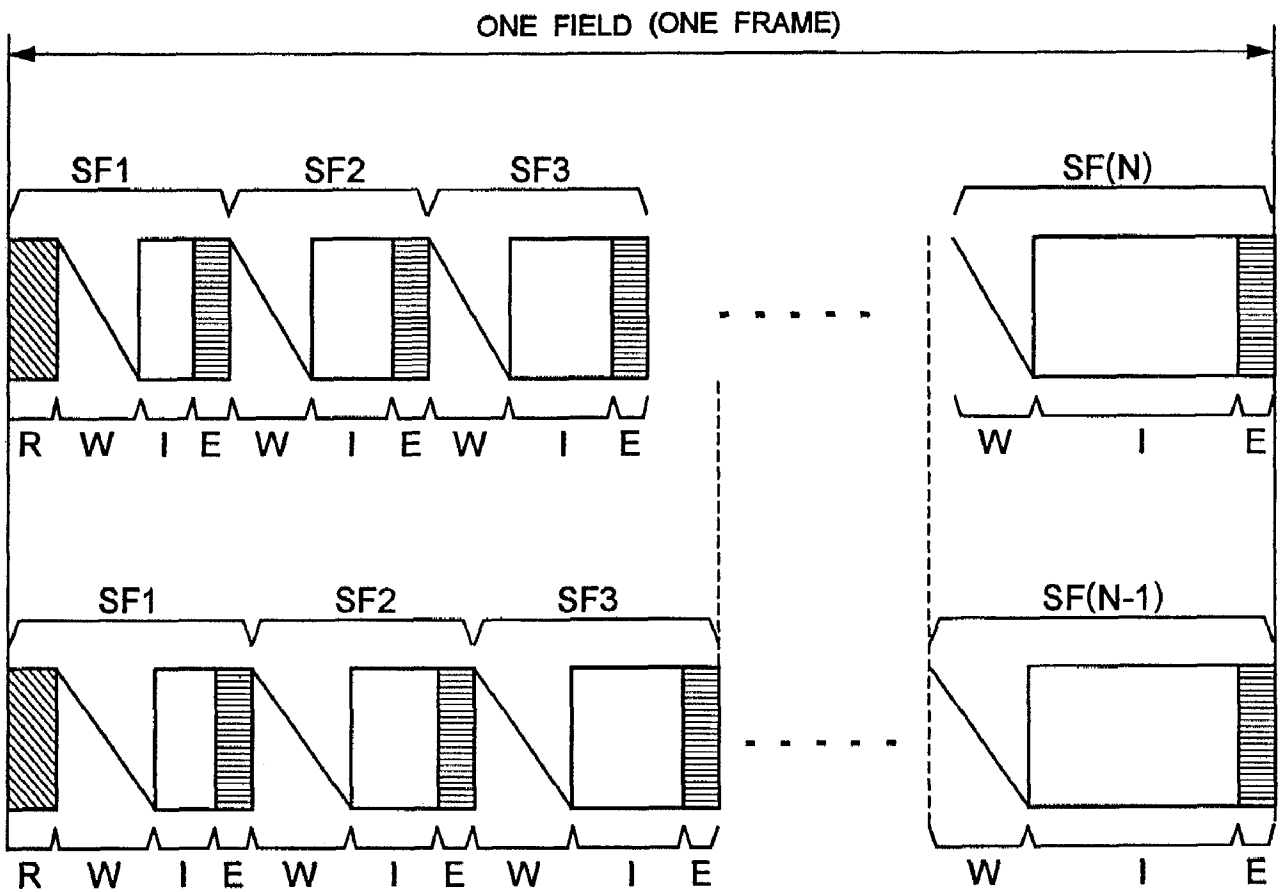
FIGS. 16A and 16B show another examples of the light emission drive sequences that are adopted by the plasma display apparatus shown in FIG. 1.

To deal with this discharge delay, the drive control circuit 56 executes grayscale driving in accordance with the light emission drive sequence as shown in FIG. 16A until the accumulated usage time of the PDP50 at the present time exceeds the predetermined time t1 as shown in FIG. 15, and the drive control circuit 56 executes grayscale driving in accordance with the light emission drive sequence as shown in FIG. 16B when the time t1 is exceeded. The light emission drive sequence shown in FIG. 16A performs grayscale driving by dividing a single field display period into N subfields SF1 to SF(N) and is the same as the light emission drive sequence shown in FIG. 10. On the other hand, the light emission drive sequence shown in FIG. 16B is rendered by creating (N-1) subfields by reducing the number of subfields in the light emission drive sequence shown in FIG. 10 by one. The fact that the address process W, sustain process I and erasure process E are sequentially executed in each subfield and the fact that the reset process R is executed prior to the address process W in the first subfield SF1 alone are the same as for the light emission drive sequence shown in FIG. 10. When the drive shown in FIG. 16B is executed, the pulse width Wa of the scan pulse SP (or pixel data pulse DP) applied in the address process W of each subfield and the pulse width Wb of the sustain pulse $IP_Y$ that is first applied in the sustain process I of each subfield are each widened by the amount (time) produced by reducing the number of subfields by one.

As a result, even when a discharge lag occurs in the address discharge as a result of long-time use, discharge can be reliably induced.

Although the discharge cells PC are formed between the row electrode X and the associated row electrode Y of the row electrode pair $(X_1, Y_1), (X_2, Y_2), (X_3, Y_3), \ldots, (X_n, Y_n)$ in the PDP 50 of the above-described embodiment, the discharge cells PC may be formed between each two adjacent row electrodes. Specifically, the discharge cells PC may be formed between the row electrodes $X_1$ and $Y_1$, row electrodes $Y_1$ and $X_2$, row electrodes $X_2$ and $Y_2, \ldots$, row electrodes $Y_{n-1}$ and $X_n$, and row electrodes $X_n$ and $Y_n$.

Although the row electrodes X and Y are formed on the front substrate 10 and the column electrodes D and fluorescent layer 17 are formed on the rear substrate 14 in the above-described embodiment, the row electrodes X and Y may be formed together with the column electrodes D on the front substrate 10 and the fluorescent layer 17 may be formed on the rear substrate 14.

SECOND EMBODIMENT

A second embodiment of the present invention will be described in detail hereinbelow with reference to FIGS. 17 to 29.

Figure 17:
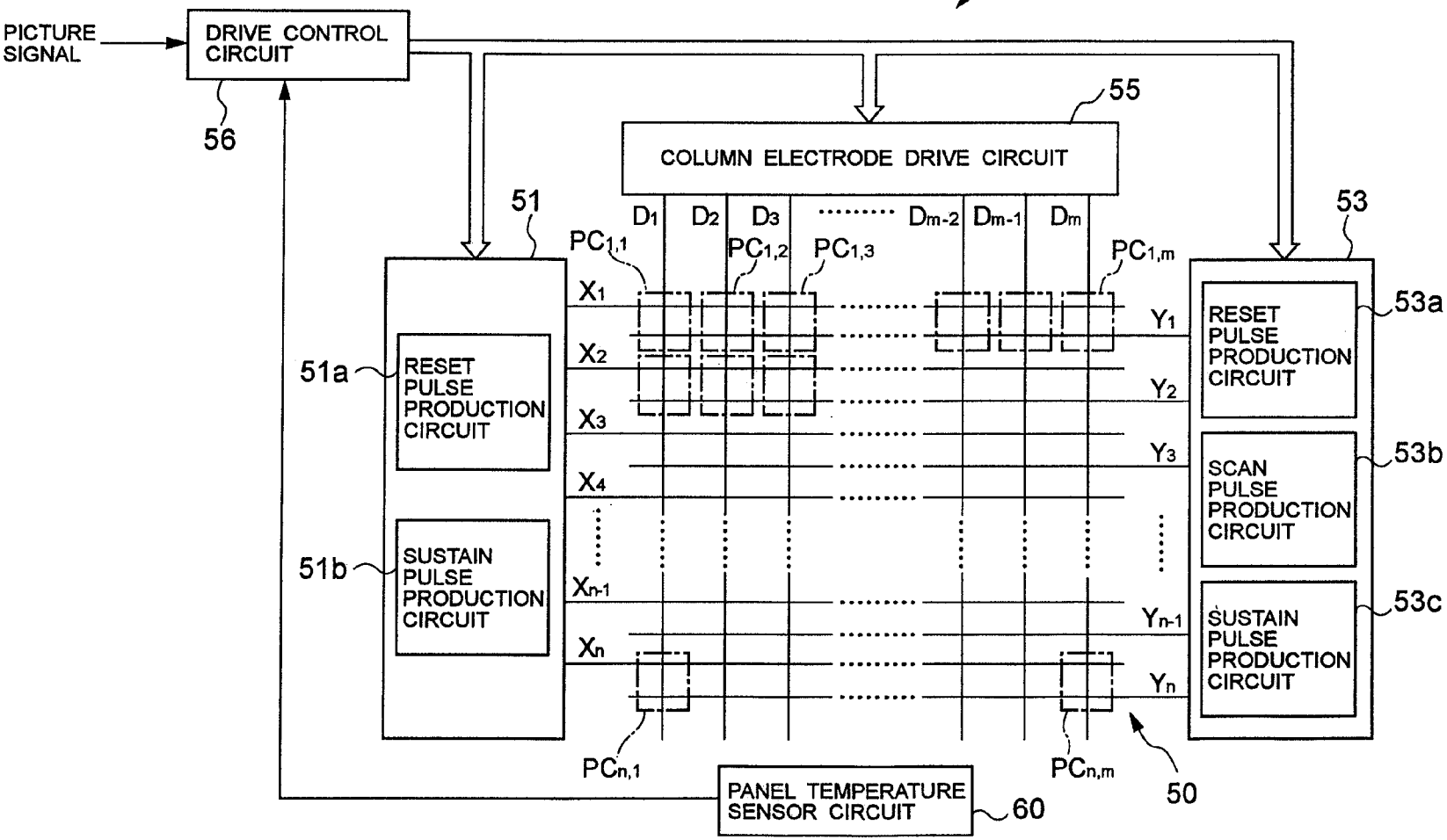
FIG. 17 shows the schematic constitution of the plasma display apparatus according to a second embodiment of the present invention.

FIG. 17 shows a schematic constitution of the plasma display apparatus 49 of the second embodiment of the present invention. Similar reference numerals and symbols are assigned to similar elements in the first and second embodiments.

As shown in FIG. 17, the plasma display apparatus 49 includes a PDP 50, a row electrode X drive circuit 51, a row electrode Y drive circuit 53, a column electrode drive circuit 55, a drive control circuit 56, and a panel temperature sensor 60.

The PDP 50 has column electrodes $D_1$ to $D_m$ and row electrodes $X_1$ to $X_n$ and $Y_1$ to $Y_n$. The column electrodes $D_1$ to $D_m$ extend in the heighth direction (vertical direction) of a two-dimensional display screen of the PDP 50, and the row electrodes $X_1$ to $X_n$ and row electrodes $Y_1$ to $Y_n$ extend in the width direction (horizontal direction) of the display screen. Each two adjacent row electrode pairs X and Y define a display line of the PDP. The row electrode pairs $(X_1, Y_1)$, $(X_2, Y_2)$, $(X_3, Y_3)$, . . . , $(X_n, Y_n)$ are first to nth display lines in the PDP50. Discharge cells PC which serve as pixels are formed at intersections (area surrounded by a single-dot chain line in FIG. 1) between the display lines and column electrodes $D_1$ to $D_m$. The discharge cells $PC_{1,1}$ to $PC_{1,m}$ belonging to the first display line, discharge cells $PC_{2,1}$ to $PC_{2,m}$ belonging to the second display line, . . . and discharge cells $PC_{n,1}$ to $PC_{n,m}$ belonging to the nth display line are arranged in a matrix shape in the PDP 50.

Figure 18:
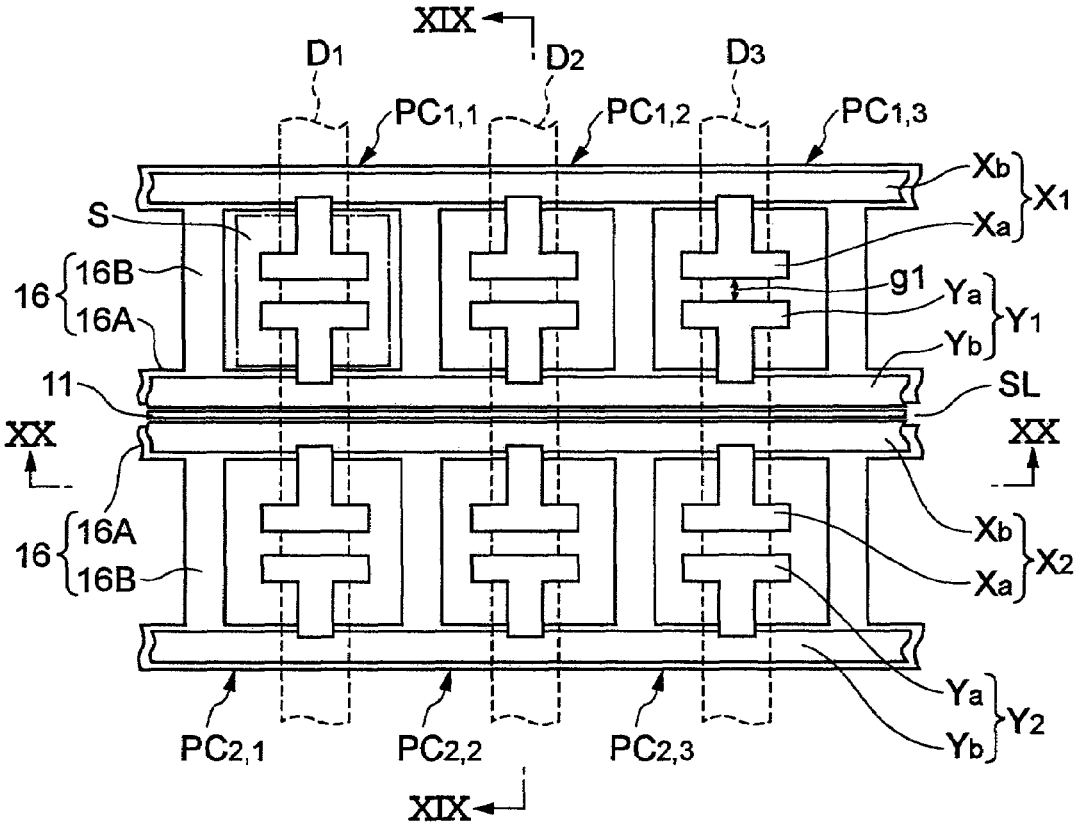
FIG. 18 is a front view that schematically shows the internal structure of the PDP mounted in the plasma display apparatus in FIG. 17 when viewed from the display screen side.

FIG. 18 is a view that schematically shows the internal structure of the PDP 50 when viewed from the display screen side.

Figure 19:
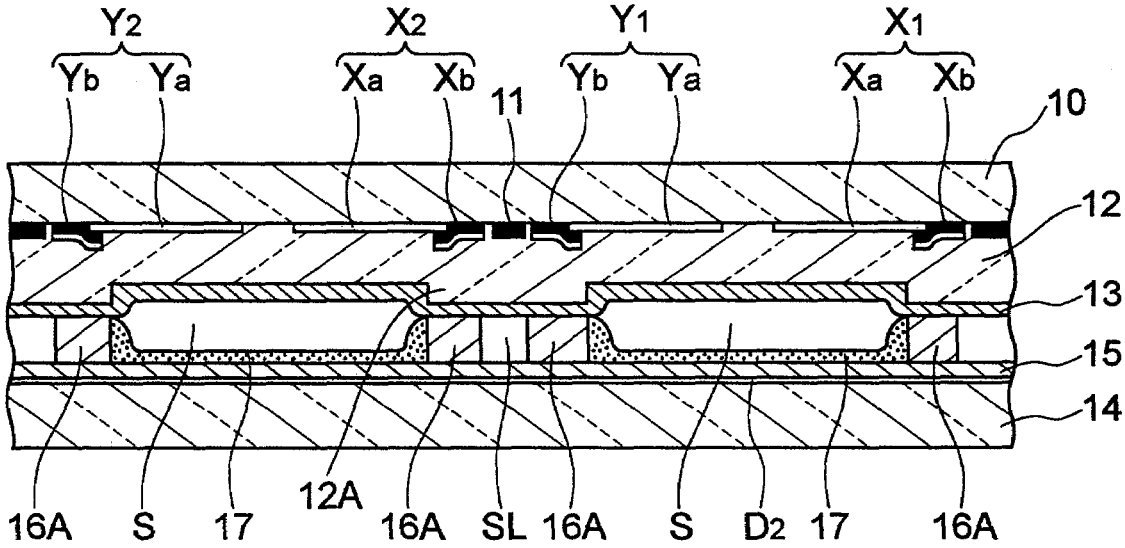
FIG. 19 shows a cross-sectional view along the line XIX-XIX shown in FIG. 18.
Figure 20:
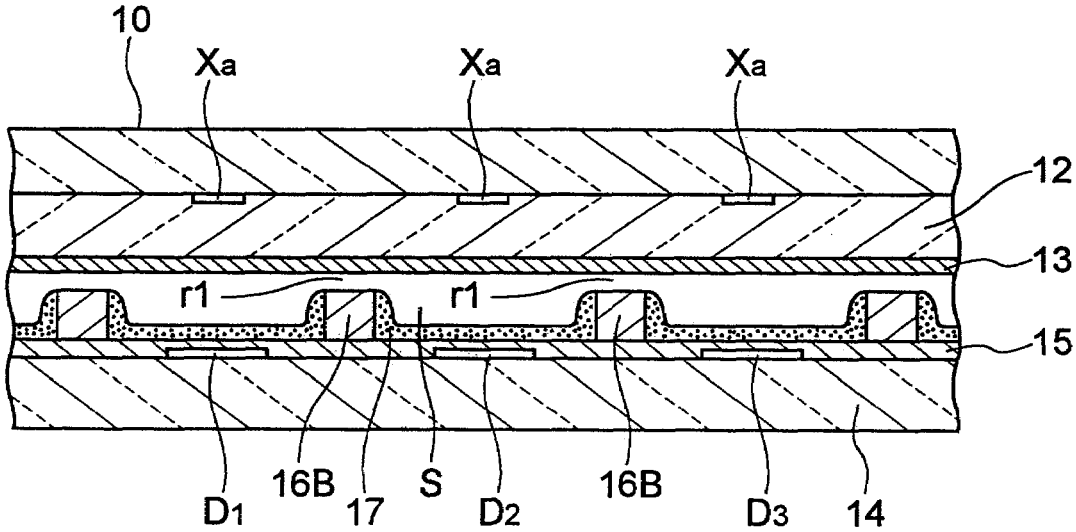
FIG. 20 shows a cross-sectional view along the line XX-XX shown in FIG. 18.

In FIG. 18, intersections between column electrodes $D_1$ to $D_3$ and the first display line $(Y_1, X_1)$ and the second display line $(Y_2, X_2)$ of the PDP 50 are shown. FIG. 19 shows a cross-sectional view of the PDP50 along the line XIX-XIX in FIG. 18, and FIG. 20 shows a cross-sectional view of the PDP50 along the line XX-XX in FIG. 18.

As shown in FIG. 18, each of the row electrodes X has a bus electrode Xb that extends in the horizontal direction of the display screen, and a plurality of T-shaped transparent electrodes Xa that extend perpendicularly from the bus electrode Xb. Each transparent electrode Xa extends at the position of the corresponding discharge cell PC. Each of the row electrodes Y has a bus electrode Yb that extends in the horizontal direction of the display screen, and a plurality of T-shaped transparent electrodes Ya that extend perpendicularly from the bus electrode Yb. Each transparent electrode Ya is provided at the position of the corresponding discharge cell PC. The transparent electrodes Xa and Ya are made from a transparent electrically conductive film of ITO or the like, for example, and the bus electrodes Xb and Yb are made from a metal film, for example. The row electrodes X and row electrodes Y are formed on the rear side of the front transparent substrate 10 as shown in FIG. 19. The front side of the front substrate 10 is the display screen face of the PDP50. In each row electrode pair (X, Y), the transparent electrode Xa extends toward the mating transparent electrode Ya. A discharge gap g1 of a predetermined length is formed between the mating T-head electrodes Xa and Ya. A black or dark-colored light absorption layer (light-blocking layer) 11 that extends in the horizontal direction of the display screen is formed between a row electrode pair $(X_1, Y_1)$ and an adjacent row electrode pair $(X_2, Y_2)$ on the rear side of the front substrate 10. A dielectric layer 12 is formed to cover the row electrode pairs (X, Y) on the rear side of the front substrate 10. The dielectric layer 12 has raised portions 12A extending downward. The raised dielectric layer 12A is formed in a part corresponding with an area where the light absorption layer 11 and neighboring bus electrodes Xb and Yb are formed, as shown in FIG. 19. A magnesium oxide layer 13 is formed on the surfaces of the dielectric layer 12 and raised dielectric layer 12A. The magnesium oxide layer 13 contains magnesium oxide crystals and performs cathode luminescence light emission with a peak in the 200 to 300 nm waveband upon excitation by means of electron beam irradiation.

Each of the column electrodes D extends on a rear substrate 14 in a direction orthogonal to the row electrode pair (X, Y) such that the column electrode D faces the transparent electrodes Xa and Ya of the row electrode pairs (X, Y). The rear substrate 14 is arranged in parallel with the front transparent electrode 10. A white column electrode protective layer 15 that covers the column electrodes D is also formed on the rear substrate 14. Barrier walls 16 are formed on the column electrode protective layer 15. Each barrier wall 16 is formed in a ladder shape by two lateral walls 16A and a plurality of vertical walls 16B. The lateral walls 16A extend in the width direction of the display screen in positions corresponding with the bus electrodes Xb and Yb of the row electrode pair (X, Y), and the vertical walls 16B extend in the vertical direction of the display screen in middle positions between the respective adjacent column electrodes D. The ladder-shaped barrier wall 16 as shown in FIG. 18 is formed for each of the display lines of the PDP50 and a gap SL as shown in FIG. 18 exists between adjacent barrier walls 16. The discharge cells PC, each of which includes an independent discharge space S and transparent electrodes Xa and Ya, are divided by the ladder-shaped barrier wall 16. A discharge gas containing xenon gas fills each discharge space S. As shown in FIG. 19, a fluorescent layer 17 is formed to completely cover the side of the horizontal wall 16A, the side of the vertical wall 16B, and the surface of the column electrode protective layer 15 in each discharge cell PC. The fluorescent layer 17 is one of three types of fluorescent material, which are a fluorescent material emitting red light, a fluorescent material emitting green light, and a fluorescent material emitting blue light. The discharge space S and gap SL of each discharge cell PC are closed off from one another because the magnesium oxide layer 13 abuts against the horizontal wall 16A as shown in FIG. 19. On the other hand, as shown in FIG. 20, because the vertical wall 16B does not abut against the magnesium oxide layer 13, a gap r1 exists between the vertical wall 16B and the magnesium oxide layer 13. That is, the discharge spaces S of the respective discharge cells PC that are adjacent in the width direction of the display screen communicate with one another via the gaps r1.

Figure 21A:
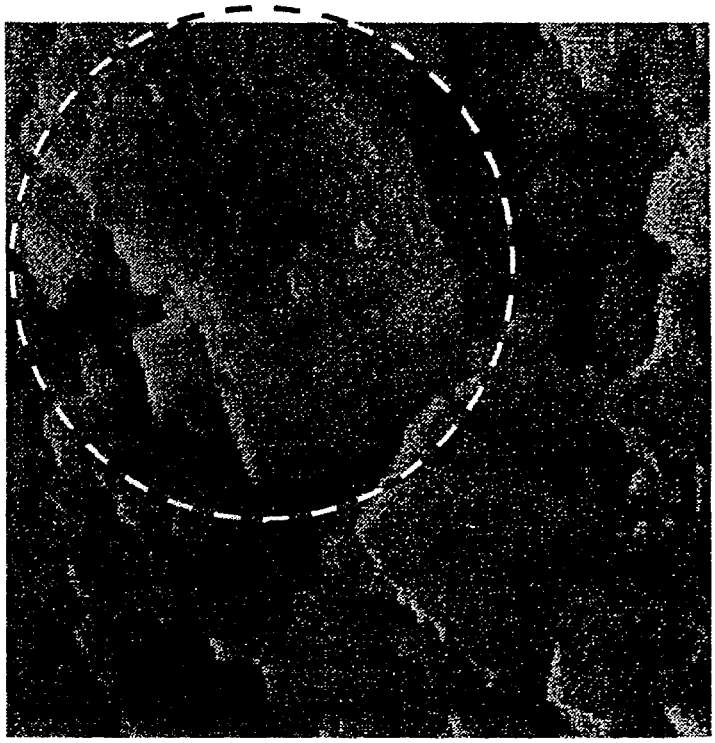
FIG. 21A shows an example of the magnesium oxide single crystals.
Figure 21B:
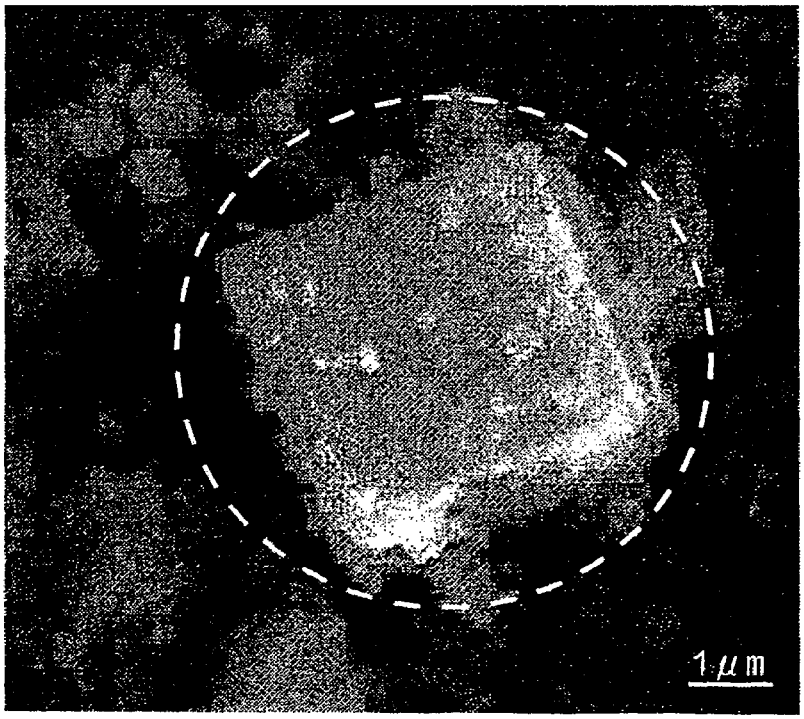
FIG. 21B shows another example of the magnesium oxide single crystals.
Figure 22:
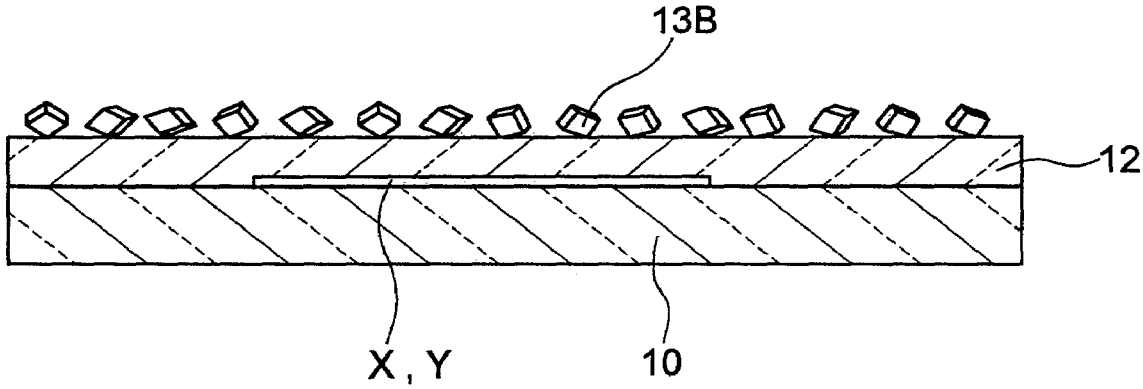
FIG. 22 shows a magnesium oxide layer which is formed by causing magnesium oxide single crystals to adhere to the surfaces of a dielectric layer including raised portions.

The magnesium oxide crystals of the magnesium oxide layer 13 are single crystals that are obtained by subjecting magnesium vapor produced by heating magnesium to vapor-phase oxidation. One example of such single crystals are vapor-phase magnesium oxide crystals that perform CL light emission with a peak in the bandwidth 200 to 300 nm (close to 235 nm in the bandwidth 230 to 250 nm in particular) upon being excited by electron beam irradiation, for example. The vapor-phase magnesium oxide crystals have magnesium single crystals of a grain diameter of 2000 angstroms or more that have a multilayer crystal structure in which cubic crystals are fitted together as shown in the SEM photographic image in FIG. 21A or a cubic single-crystal structure as shown in the SEM photographic image in FIG. 21B. In comparison with magnesium oxide that is generated by other methods, these magnesium single crystals have characteristics such as highly pure, minute grains and small grain cohesion (agglomeration). These characteristics contribute to improvements in discharge characteristics such as discharge lag. In this embodiment, vapor phase magnesium oxide single crystals with an average grain diameter of 500 angstrom or more and preferably with an average grain diameter of 2000 angstrom or more measured by means of BET are employed. The magnesium oxide layer 13 is formed by causing such magnesium oxide single crystals to adhere to the surface of the dielectric layer 12 as shown in FIG. 22 by means of spraying, electrostatic coating, or the like. Alternatively, the magnesium oxide layer 13 may be formed by forming a thin-film magnesium oxide layer by means of vapor deposition or sputtering on the surface of the dielectric layer 12 and raised portions 12A and then causing the vapor phase magnesium oxide single crystals to adhere to the thin-film magnesium oxide layer.

The row electrode X drive circuit 51 has a reset pulse production circuit 51*a* and a sustain pulse production circuit 51*b*.

The reset pulse production circuit 51*a* of the row electrode X drive circuit 51 generates a reset pulse that has a pulse voltage indicated by a reset pulse generation signal supplied from the drive control circuit 56, and applies the reset pulse to the row electrodes X of the PDP50. The sustain pulse production circuit 51*b* of the row electrode X drive circuit 51 produces a sustain pulse that has a pulse voltage indicated by a sustain pulse generation signal that is supplied from the drive control circuit 56 and applies the sustain pulse to the row electrodes X of the PDP50.

The row electrode Y drive circuit 53 includes a reset pulse production circuit 53*a*, a scan pulse production circuit 53*b* and a sustain pulse production circuit 53*c*.

The reset pulse production circuit 53*a* of the row electrode Y drive circuit 53 produces a reset pulse that has a pulse voltage that is indicated by a reset pulse generation signal supplied from the drive control circuit 56 and applies the reset pulse to the row electrodes Y of the PDP50. The scan pulse production circuit 53*b* of the row electrode Y drive circuit 53 produces a scan pulse that has a pulse voltage indicated by a scan pulse generation signal supplied from the drive control circuit 56 and sequentially applies the scan pulse to the row electrodes $Y_1$ to $Y_n$ of the PDP50. The sustain pulse production circuit 53*c* of the row electrode Y drive circuit 53 produces a sustain pulse that has a pulse voltage that is indicated by a sustain pulse generation signal supplied by the drive control circuit 56 and applies the sustain pulse to the row electrodes Y of the PDP50. The column electrode drive circuit 55 produces a pixel data pulse that is to be applied to the column electrodes D of the PDP50 in accordance with a pixel data pulse generation signal supplied from the drive control circuit 56.

A panel temperature sensor 60 measures the temperature of the PDP50 and supplies the panel temperature signal indicating the detected temperature to the drive control circuit 56. For example, the panel temperature sensor 60 measures the PDP temperature at predetermined intervals.

Figures 23A, 23B:
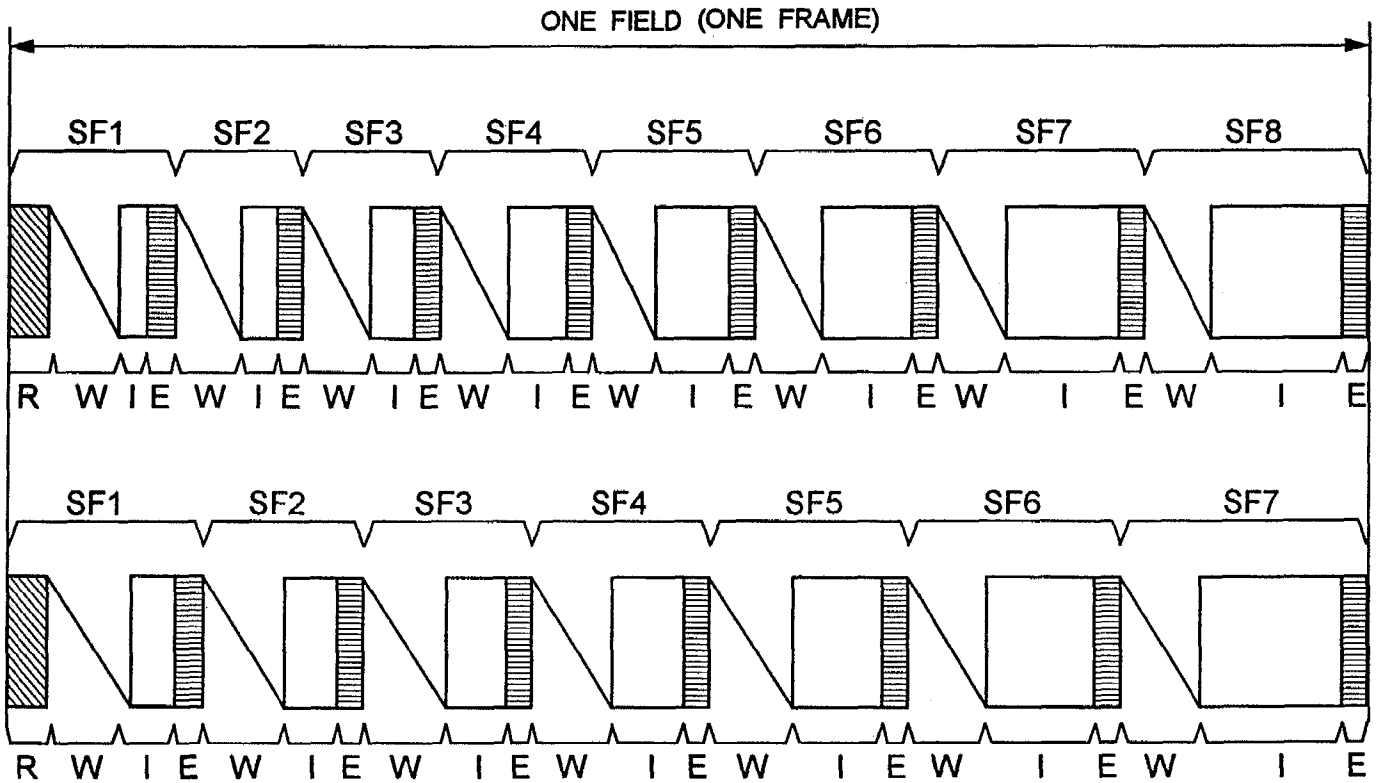
FIG. 23A and FIG. 23B show an example of light emission drive sequences that are adopted by the plasma display apparatus shown in FIG. 17.

The drive control circuit 56 supplies a variety of control signals for driving the PDP50 to the row electrode X drive circuit 51, row electrode Y drive circuit 53 and column electrode drive circuit 55 in accordance with the light emission drive sequence shown in FIG. 23A when the temperature of the PDP50 indicated by the panel temperature signal is equal to or more than a predetermined temperature (10° C., for example), and in accordance with the light emission drive sequence shown in FIG. 23B when the temperature of the PDP50 is less than the predetermined temperature.

The light emission drive sequence shown in FIGS. 23A and 23B implement grayscale driving of the PDP50 on the basis of the subfield method. In the light emission drive sequence shown in FIG. 23A, one field's (or one frame's) worth of an image display is divided into eight subfields SF1 to SF8, and in the light emission drive sequence shown in FIG. 23B, one field's (or one frame's) worth of an image display is divided into seven subfields SF1 to SF7. In both of the light emission drive sequences shown in FIGS. 23A and 23B, an address process W, sustain process I and erasure process E are sequentially executed in each of the subfields. A reset process R is executed before the address process W only in the leading subfield SF1. Each subfield has its own weighting.

Figure 24:
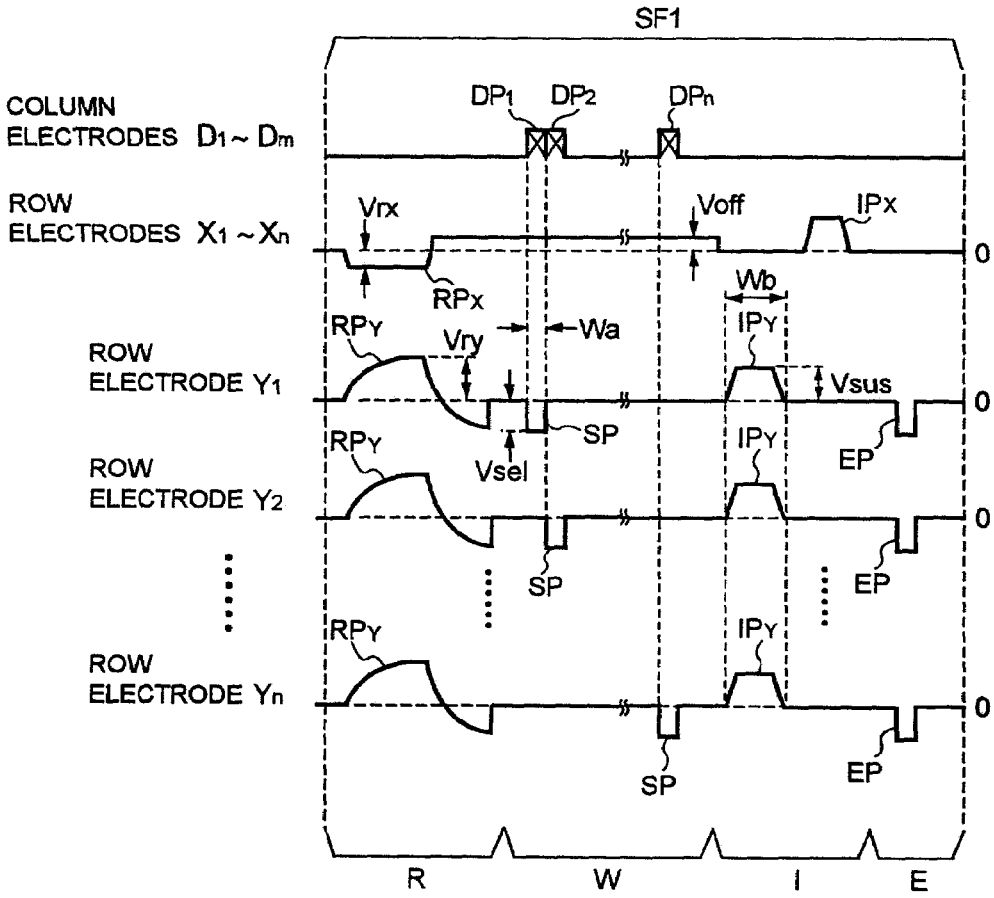
FIG. 24 shows various drive pulses applied to the PDP in accordance with the light emission drive sequence shown in FIG. 23A and FIG. 23B, and the application timing of the drive pulses.

FIG. 24 shows the application timing of a variety of drive pulses that are applied to the column electrodes D and row electrodes X and Y of the PDP50 during the first subfield SF1.

First, as shown in FIG. 24, in the reset process R, the row electrode Y drive circuit 53 produces a reset pulse $RP_Y$ with a leading portion in which the voltage of the row electrode Y rises slowly as time elapses and reaches a peak voltage Vry of a positive polarity and a trailing portion in which the voltage value drops slowly to reach a voltage of a negative polarity, and simultaneously applies the reset pulse $RP_Y$ to the row electrodes $Y_1$ to $Y_n$. The row electrode X drive circuit 51 produces a reset pulse $RP_X$ having a voltage Vrx of a negative polarity as shown in FIG. 24 that spans the rising segment of the voltage value of the reset pulse $RP_Y$ and applies the reset pulse $RP_X$ to the row electrodes $X_1$ to $X_n$ respectively. A weak write reset discharge is induced across the row electrodes X and Y in each of all the discharge cells $PC_{1,1}$ to $PC_{n,m}$ while the reset pulses $RP_Y$ and $RP_X$ are applied. After the write reset discharge ends, a wall charge of a predetermined amount is formed at the surface of the magnesium oxide layer 13 in the discharge space S of each discharge cell PC. Specifically, charge of a positive polarity is formed in the vicinity of the row electrodes X on the surface of the magnesium oxide layer 13 and charge of a negative polarity is formed in the vicinity of the row electrodes Y. Thereafter, when the voltage of the reset pulse $RP_Y$ drops slowly from Vry, a weak erasure reset discharge is induced over this interval across the row electrodes X and Y in all of the discharge cells $PC_{1,1}$ to $PC_{n,m}$. The wall charges formed in all of the discharge cells $PC_{1,1}$ to $PC_{n,m}$ are cancelled as a result of the erasure reset discharge. That is, as a result of the reset process R, all of the discharge cells $PC_{1,1}$ to $PC_{n,m}$ are initialized in a unlit state in which the amount of wall charge is less than a predetermined amount.

In the address process W, the column electrode drive circuit 55 generates a pixel data pulse to decide whether to cause each of the discharge cells PC to emit light in the subfield concerned, based on the input picture signal. For example, the column electrode drive circuit 55 generates a high voltage pixel data pulse for each discharge cell PC when causing the discharge cell PC to emit light and a low voltage pixel data pulse when not causing the discharge cell PC to emit light. The column electrode drive circuit 55 sequentially applies this pixel data pulse for one display line (m display lines) at a time as pixel data pulse group $DP_1$, $DP_2$, $DP_n$ to the column electrodes $D_1$ to $D_m$. The row electrode Y drive circuit 53 sequentially applies a scan pulse SP with a voltage of a negative polarity to the row electrodes $Y_1$ to $Y_n$ in sync with the timing of each of the pixel data pulse groups $DP_1$ to $DP_n$. Address discharge is induced in only those discharge cells PC to which the scan pulse SP is applied and a high voltage pixel data pulse is applied. After this address discharge ends, a wall charge of a predetermined amount is formed at the surfaces of the magnesium oxide layer 13 and the fluorescent layer 17 respectively in the discharge space S of the discharge cell PC. On the other hand, address discharge is not induced in those discharge cells PC to which the scan pulse SP is applied but a low-voltage pixel data pulse is applied. Thus, the wall-charge formation state up until just before this point is maintained in these discharge cells. That is, as a result of execution of the address process W, each of the discharge cells PC is set into either a lit state where wall charge of a predetermined amount exists or an unlit state in which wall charge of a predetermined amount does not exist on the basis of the input picture signal.

When the driving shown in FIG. 23B is performed, the column electrode drive circuit 55 and row electrode Y drive circuit 53 produce a scan pulse SP and a pixel data pulse DP with a wide pulse width Wa in comparison with cases where the driving shown in FIG. 23A is performed. That is, when the panel temperature of the PDP50 is below a predetermined temperature, the pulse width Wa of the scan pulse SP and pixel data pulse DP is made wider in comparison with a case where the panel temperature of the PDP50 is above the predetermined temperature.

In the sustain process I, the row electrode X drive circuit 51 and row electrode Y drive circuit 53 produces sustain pulses $IP_X$ and $IP_Y$ with a voltage Vsus of a positive polarity repeatedly a number of times corresponding with the weighting of the subfield concerned, and alternately applies the sustain pulses $IP_X$ and $IP_Y$ to the row electrodes $X_1$ to $X_n$ and $Y_1$ to $Y_n$ as shown in FIG. 24. Each time the sustain pulses $IP_X$ and $IP_Y$ are applied, only the discharge cells PC that have been set in the lit mode state in which a wall charge of a predetermined amount is formed produce sustain discharge, whereby the fluorescent layer 17 emits light in accordance with the discharge and an image is formed on the face (display screen) of the panel.

When the driving shown in FIG. 23B is performed, the row electrode X drive circuit 51 and row electrode Y drive circuit 53 produce a sustain pulse with a widened pulse width Wb, in comparison with cases where the driving shown in FIG. 23A is performed, with respect to only the sustain pulse $IP_Y$ that is applied first in the sustain process I.

In erasure process E, the row electrode Y drive circuit 53 applies an erasure pulse EP of a positive polarity simultaneously to all the row electrodes $Y_1$ to $Y_n$. An erasure discharge is induced in all the discharge cells PC as a result of the application of the erasure pulse EP, and the wall charges remaining in the discharge cells PC are all cancelled.

Figure 25:
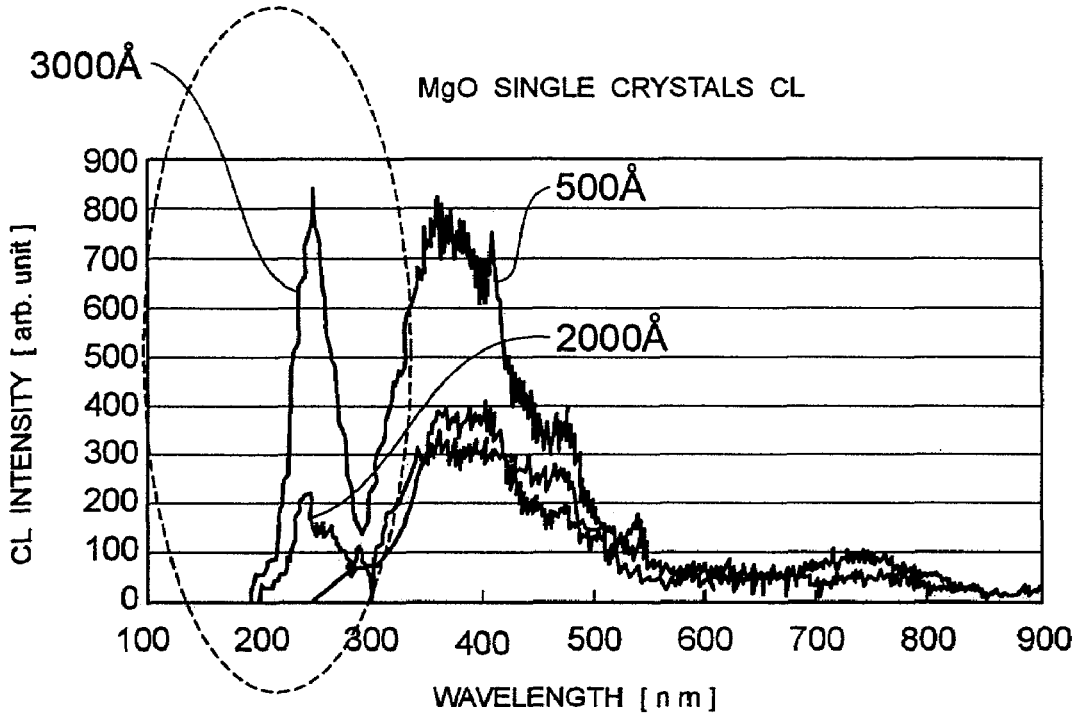
FIG. 25 is a graph showing the relationship between the grain diameter of the magnesium oxide single crystals and the wavelength of the CL light emission.
Figure 26:
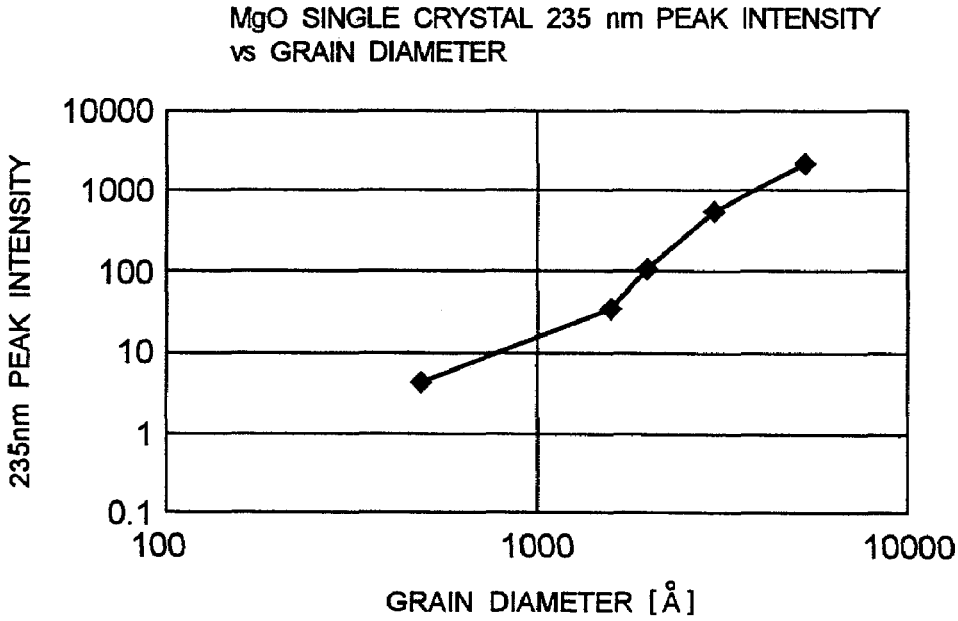
FIG. 26 is a graph showing the relationship between the grain diameter of the magnesium oxide single crystals and the intensity of 235 nm CL light emission.

As mentioned earlier, the vapor phase magnesium oxide single crystals contained in the magnesium oxide layer 13 formed in each of the display cells PC perform CL light emission with a peak in the 200 to 300 nm waveband (close to 235 nm within 230 to 250 nm in particular) as shown in FIG. 25 upon excitation by means of electron-beam irradiation. As shown in FIG. 26, the larger the grain diameter of the vapor-phase magnesium oxide crystals, the greater the peak intensity of the CL light emission. That is, when the magnesium is heated at a higher temperature than normal during generation of vapor-phase magnesium oxide crystals, vapor-phase magnesium oxide single crystals with an average grain diameter of 500 angstroms and relatively large single crystals with a grain diameter of at least 2000 angstroms as shown in FIG. 21A or FIG. 21B are formed. Because the temperature when magnesium is heated is higher than normal temperature, the length of the flames when magnesium reacts with oxygen is also long. Therefore, the temperature difference between these flames and the surroundings is large and, as a result, it is inferred that, as vapor-phase magnesium oxide single crystals have a larger grain diameter, a large number of single crystals with a high energy level corresponding with 200 to 300 nm (close to 235 nm in particular) are contained.

Figure 27:
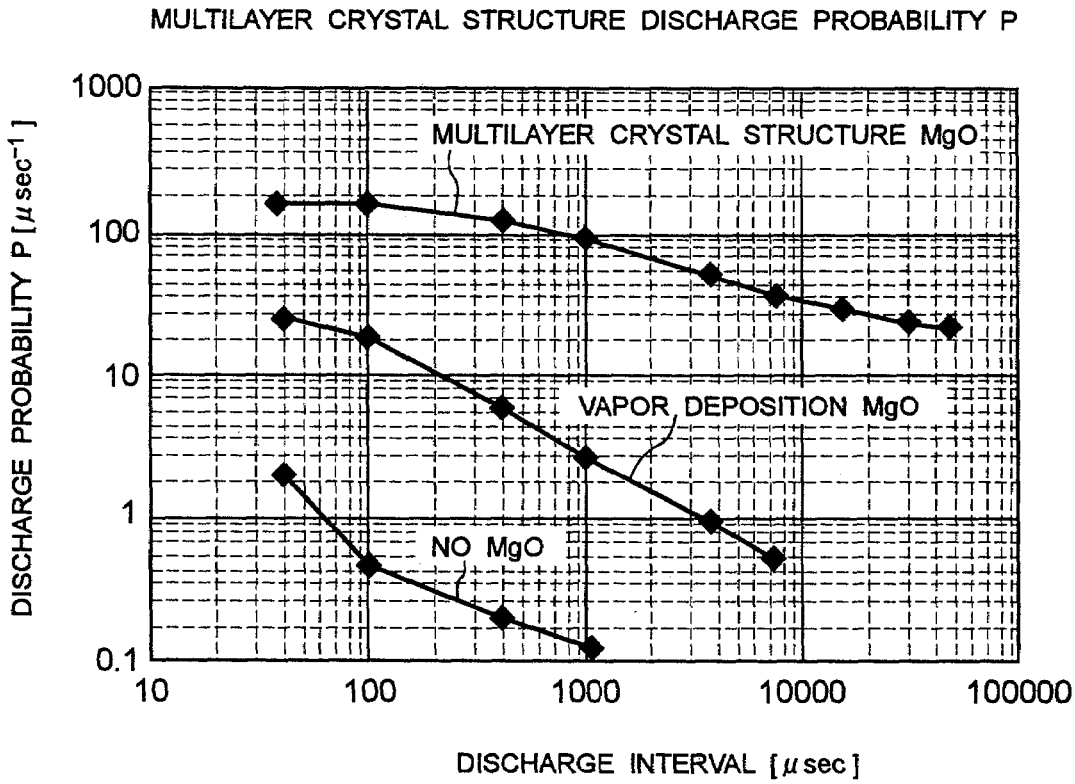
FIG. 27 shows the discharge probabilities in cases where a magnesium oxide layer is not provided in the discharge cells, where a magnesium oxide layer is formed by means of conventional vapor deposition, and where a magnesium oxide layer having vapor-phase magnesium oxide single crystals that produce CL light emission with a peak of 200 to 300 nm upon electron beam irradiation is provided.

FIG. 27 shows the discharge probabilities in cases where a magnesium oxide layer is not provided in the discharge cell PC, where a magnesium oxide layer is formed by means of conventional vapor deposition, and where a magnesium oxide layer having vapor-phase magnesium oxide single crystals that produce CL light emission with a peak of 200 to 300 nm (particularly 230 to 250 nm, and more particularly around 235 nm) upon electron beam irradiation is provided. The horizontal axis in FIG. 27 represents the discharge interval, i.e., time interval from when discharge is induced to until the following discharge is induced.

Figure 28:
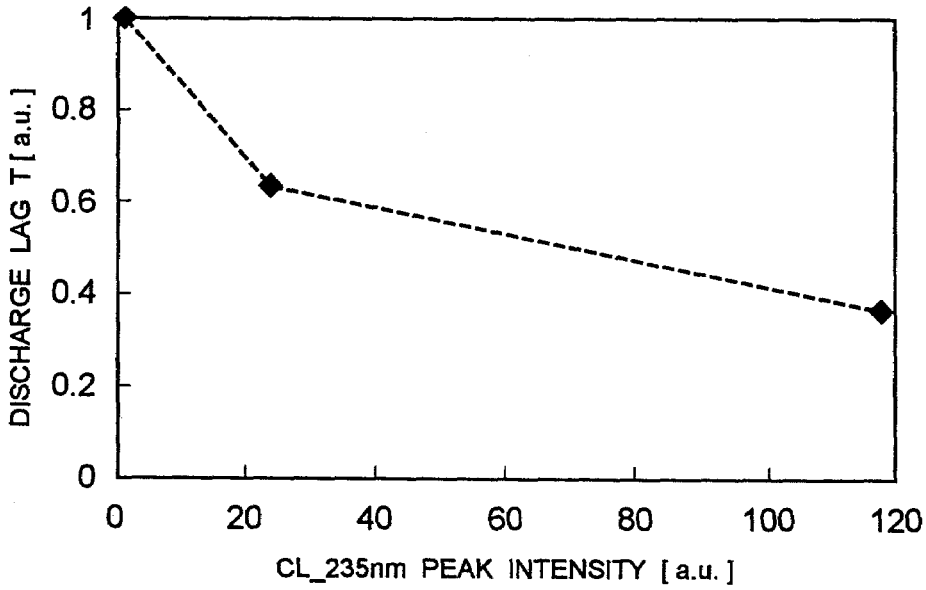
FIG. 28 shows the relationship between the 235 nm peak CL light emission intensity and the discharge lag time.

Thus, if the magnesium oxide layer 13 containing the vapor-phase magnesium oxide single crystals that effect CL light emission with a peak from 200 to 300 nm (particularly 230 to 250 nm, and more particularly around 235 nm) as a result of electron beam irradiation as shown in FIG. 21A or FIG. 21B is formed in the discharge space S of each discharge cell PC, the discharge probability increases in comparison with a case where a magnesium oxide layer is formed by means of conventional vapor deposition. As shown in FIG. 28, the larger the intensity of CL light emission with a peak at 235 nm in particular when the vapor-phase magnesium oxide single crystals are irradiated with an electron beam, the more the discharge lag induced in the discharge space S can be reduced.

Therefore, even when the reset discharge is made weak by slowly producing a voltage transition of the reset pulse $RP_Y$ applied to the row electrodes Y as shown in FIG. 24 in order to increase contrast by suppressing the light emission in accordance with the reset discharge that does not play a part in the display image, this weak reset discharge can be induced stably in a short time. In particular, each of the discharge cells PC adopts a structure for inducing localized discharge in the vicinity of the discharge gap between the T-shaped transparent electrodes Xa and Ya. Therefore, a sudden strong reset discharge which would result in discharging in the whole of the row electrode is suppressed and strong erroneous discharge between the column electrodes and row electrodes is also prevented. Because the discharge probability is increased, the priming effect resulting from the write reset discharge and erasure reset discharge in the reset process R continues for a long time. Hence, the address discharge induced in the address process W and the sustain discharge induced in the sustain process I are accelerated. As a result, the pulse width Wa of the pixel data pulse DP and scan pulse SP as shown in FIG. 24 that are applied to the column electrodes D and row electrodes Y to induce address discharge can be shortened and the processing time that is devoted to the address process W can be shortened to the same extent. Further, the pulse width of the sustain pulse IP that is applied to the row electrodes X and Y in order to induce sustain discharge can be shortened and the processing time that is devoted to the sustain process I can be shortened to the same extent. Therefore, the number of subfields that are to be provided in the display period of one field (or one frame) can be increased to the extent that the processing time that is devoted to the address process W and sustain process I respectively is shortened. Accordingly, the number of grayscales can be increased.

As described above, the discharge probability in the respective discharge cells can be increased by providing the magnesium oxide layer 13 having vapor-phase magnesium oxide single crystals which effects CL light emission with a peak of 200 to 300 nm as a result of electron beam irradiation.

Figure 29A:
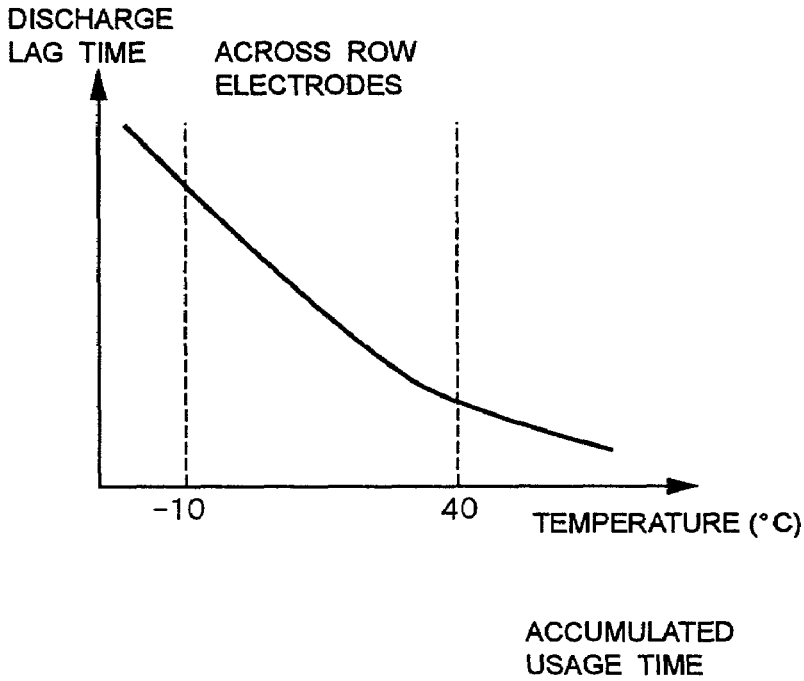
FIG. 29A shows the relationship between the display panel temperature and the discharge lag produced between row electrodes.
Figure 29B:
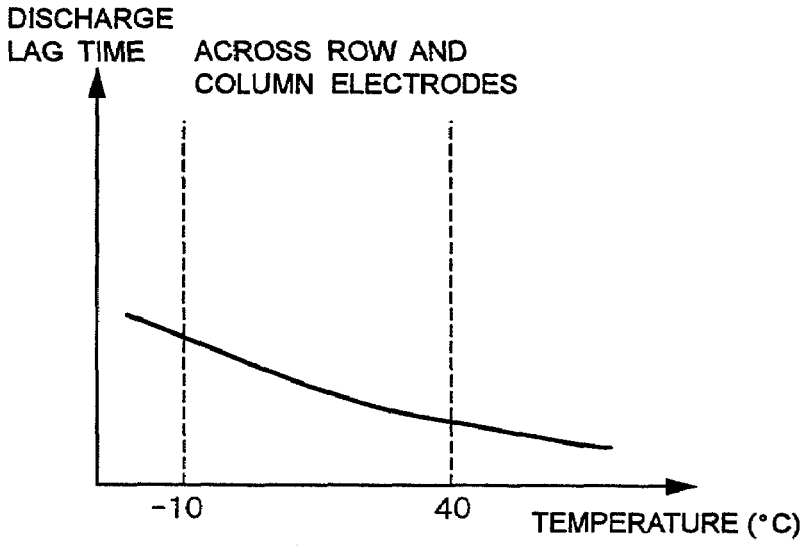
FIG. 29B shows the relationship between the display panel temperature and the discharge lag produced between row and column electrodes.

However, when the panel temperature of the PDP50 drops, a discharge lag as shown in FIG. 29A is produced in the sustain discharge induced across the row electrodes X and Y in each discharge cell and a discharge lag as shown in FIG. 29B is produced in the address discharge induced across the row electrodes Y and column electrodes D. Therefore, when the pulse width of the scan pulse and sustain pulse applied in order to induce the address discharge and sustain discharge is short, discharge is not readily induced.

Therefore, in this embodiment, when the panel temperature of the PDP50 is equal to or more than a predetermined temperature, the PDP50 is grayscale-driven in the eight subfields SF1 to SF8 as shown in FIG. 23A and, when the panel temperature of the PDP50 is less than the predetermined temperature, the PDP50 is grayscale-driven in the seven subfields SF1 to SF7 as shown in FIG. 23B. In other words, when the panel temperature of the PDP50 is low, the number of subfields for dividing one field (or frame) display period is reduced, and the pulse widths of the scan pulse (pixel data pulse) and sustain pulse are widened to the extent of this subfield reduction. As a result, even when a discharge lag is caused by the temperature drop, the discharge can be reliably induced.

The present invention is not limited to the above described and illustrated embodiment. For example, the discharge cells PC are formed between the row electrode X and row electrode Y of each row electrode pair ($X_1$, $Y_1$), ($X_2$, $Y_2$), ($X_3$, $Y_3$), . . . , ($X_n$, $Y_n$) in the above-described embodiment, but the discharge cells PC may be formed between all the adjacent row electrodes. More specifically, the discharge cells PC may be formed between the row electrodes $X_1$ and $Y_1$, row electrodes $Y_1$ and $X_2$, row electrodes $X_2$ and $Y_2$, . . . , row electrodes $Y_{n-1}$, and $X_n$, and row electrodes $X_n$ and $Y_n$.

Although the row electrodes X and Y are formed on the front substrate 10 and the column electrodes D and fluorescent layer 17 are formed on the rear substrate 14 in the above-described embodiment, the row electrodes X and Y may be formed together with the column electrodes D on the front substrate 10 and the fluorescent layer 17 may be formed in the rear substrate 14.

This application is based on Japanese Patent Applications No. 2004-276976 filed on Sep. 24, 2004 and No. 2004-296001 filed on Oct. 8, 2004, and the entire disclosure of these two applications is incorporated herein by reference.

What is claimed is:

1. A plasma display apparatus comprising:

a plasma display panel including, a plurality of row electrode pairs extending in a row direction of the plasma display panel, a plurality of column electrodes extending in a column direction of the plasma display panel, and a plurality of discharge cells which serve as pixels at intersections between said plurality of row electrode pairs and said plurality of column electrodes, each said discharge cell having a discharge space;

a magnesium oxide layer having magnesium oxide crystals that is formed on a predetermined face of each said discharge cell, is exposed to the discharge space and performs cathode luminescence light emission with a peak in a 200 to 300 nm waveband as a result of being excited upon electron beam irradiation;

a drive portion that causes discharge in the discharge space by applying a drive pulse to each of the row electrode pairs and each of the column electrodes in accordance with a picture signal in each of a plurality of subfields that constitute a unit display period of the picture signal; and a control portion that adjusts a pulse voltage value and/or pulse width of the drive pulse in accordance with an accumulated usage time of the plasma display panel, wherein the magnesium oxide crystals have a grain diameter of 2000 angstroms or more, wherein the plurality of subfields includes an address process, wherein discharge takes place in the address process to create a wall charge in the discharge space, and wherein the magnesium oxide crystals reduce the discharge delay during the address process.

2. The plasma display apparatus according to claim 1, wherein said each subfield has an address period and a sustainable period, and the drive portion includes:

address means for setting the discharge cell in either a lit state or an unlit state by selectively inducing address discharge in the discharge cell by applying a scan pulse to one row electrode of the row electrode pair in the address period of each said subfield and applying a pixel data pulse of pixel data to the column electrodes on the basis of the picture signal;

sustain means for causing sustain discharge in only the discharge cell set in the lit state by applying a sustain pulse to each of the row electrode pairs in the sustain period of each said subfield; and reset means for inducing reset discharge in all of the discharge cells by applying a reset pulse to all of the row electrode pairs prior to the address period of at least one said subfield.

3. The plasma display apparatus according to claim 2, wherein the control portion includes:

accumulated usage time clocking means for counting the accumulated usage time; and pulse adjustment means for adjusting the pulse voltage value and/or pulse width of at least one of the reset pulse, the scan pulse, and the sustain pulse in accordance with the accumulated usage time.

4. The plasma display apparatus according to claim 3, wherein the pulse adjustment means perform pulse width adjustment on only the sustain pulse that is applied first in the sustain period of each of the subfields.

5. The plasma display apparatus according to claim 1, wherein the control portion changes the number of the subfields constituting the unit display period in accordance with the accumulated usage time.

6. The plasma display apparatus according to claim 1, wherein the control portion adjusts a signal level of each color of the picture signal in accordance with the accumulated usage time.

7. The plasma display apparatus according to claim 1, wherein the magnesium oxide crystals include magnesium oxide single crystals that are obtained through vapor oxidation of magnesium vapor that is produced as a result of heating magnesium.

8. The plasma display apparatus according to claim 1, wherein the magnesium oxide crystals perform the cathode luminescence light emission with a peak in a 230 to 250 nm waveband.

9. The plasma display apparatus according to claim 1, wherein the plasma display panel further includes a dielectric layer that covers the row electrode pairs, and the magnesium oxide layer is formed on the dielectric layer.

10. The plasma display apparatus according to claim 9, wherein the magnesium oxide layer includes a thin film of magnesium oxide formed on the dielectric layer, and magnesium single crystals adhered on the thin film of magnesium oxide.

11. The plasma display apparatus according to claim 1, wherein the magnesium oxide crystals are cubic crystals and are randomly oriented.

12. A plasma display apparatus comprising:

a plasma display panel including, a plurality of row electrode pairs extending in a row direction of the plasma display panel, a plurality of column electrodes extending in a column direction of the plasma display panel, and a plurality of discharge cells at intersections between the plurality of row electrode pairs and the plurality of column electrodes, each said discharge cell having a discharge space;

a magnesium oxide layer having magnesium oxide crystals that is formed on a predetermined face of each said discharge cell, is exposed to the discharge space and performs cathode luminescence light emission with a peak in a 200 to 300 nm waveband as a result of being excited through electron beam irradiation;

a drive portion that causes discharge in the discharge space by applying a drive pulse to each of the row electrode pairs and each of the column electrodes in accordance with a picture signal in each of a plurality of subfields that constitute a unit display period of the picture signal;

a panel temperature sensor for detecting a temperature of the plasma display panel; and a control portion that changes a pulse width of the drive pulse in accordance with the detected temperature of the plasma display panel, wherein the magnesium oxide crystals have a grain diameter of 2000 angstroms or more, wherein the plurality of subfields includes an address process, wherein discharge takes place in the address process to create a wall charge in the discharge space, and wherein the magnesium oxide crystals reduce the discharge delay during the address process.

13. The plasma display apparatus according to claim 12, wherein each said subfield has an address period and a sustainable period, each said subfield is assigned its own weighting, and the drive portion includes:

address means for setting each said discharge cell in either a lit state or an unlit state by selectively inducing address discharge in each said discharge cell by applying a scan pulse to one row electrode of the row electrode pair in the address period of each said subfield and applying a pixel data pulse of pixel data to the column electrodes on the basis of the picture signal; and sustain means for causing sustain discharge in only the discharge cell set in the lit state by repeatedly applying a sustain pulse to each of the row electrode pairs the number of times determined by the weighting of the subfield concerned, in the sustain period of each said subfield, and the control portion that changes the pulse width of the scan pulse and the sustain pulse in accordance with the detected temperature of the plasma display panel.

14. The plasma display apparatus according to claim 13, wherein, when the detected temperature of the plasma display panel is lower than a predetermined value, the control portion widens the pulse width of the scan pulse and the sustain pulse respectively in comparison with a case where the detected temperature of the plasma display panel is higher than the predetermined value.

15. The plasma display apparatus according to claim 12, wherein the control portion changes the pulse width of only the sustain pulse that is applied first among the sustain pulses applied in the sustainable period.

16. The plasma display apparatus according to claim 12, wherein the control portion includes subfield control means for changing the number of subfields constituting the unit display period in accordance with the detected temperature of the plasma display panel.

17. The plasma display apparatus according to claim 16, wherein, when the detected temperature of the plasma display panel is lower than a predetermined temperature, the subfield control means reduces the number of the subfields in comparison with a case where the detected temperature of the plasma display panel is higher than the predetermined temperature.

18. The plasma display apparatus according to claim 12, wherein the magnesium oxide crystals include magnesium oxide single crystals that are generated through vapor oxidation of magnesium vapor that is produced when magnesium is heated.

19. The plasma display apparatus according to claim 12, wherein the magnesium oxide crystals perform cathode luminescence light emission with a peak in a 230 to 250 nm waveband.

20. The plasma display apparatus according to claim 12, wherein the plasma display panel further includes a dielectric layer that covers the row electrode pairs, and the magnesium oxide layer is formed on the dielectric layer.

21. The plasma display apparatus according to claim 20, wherein the magnesium oxide layer includes a thin film of magnesium oxide formed on the dielectric layer, and magnesium single crystals adhered on the thin film of magnesium oxide.

22. The plasma display apparatus according to claim 12, wherein the magnesium oxide crystals are cubic crystals and are randomly oriented.

* * * * *